US010959485B2

(12) United States Patent
Bathum et al.

(10) Patent No.: US 10,959,485 B2
(45) Date of Patent: Mar. 30, 2021

(54) FOOTWEAR WITH DUAL MOLDED PIECE CONSTRUCTION

(75) Inventors: Dale Bathum, Boulder, CO (US); Damon Chen, Westminster, CO (US)

(73) Assignee: Crocs, Inc., Broomfield, CO (US)

( * ) Notice: Subject to any disclaimer, the term of this patent is extended or adjusted under 35 U.S.C. 154(b) by 611 days.

(21) Appl. No.: 13/460,537

(22) Filed: Apr. 30, 2012

(65) Prior Publication Data

US 2013/0118037 A1 May 16, 2013

Related U.S. Application Data

(60) Provisional application No. 61/481,083, filed on Apr. 29, 2011, provisional application No. 61/547,529, filed on Oct. 14, 2011.

(51) Int. Cl.

| | |
|---|---|
| ***A43B 9/00*** | (2006.01) |
| ***A43B 3/10*** | (2006.01) |
| ***A43B 9/18*** | (2006.01) |
| ***A43B 3/12*** | (2006.01) |
| ***A43B 3/00*** | (2006.01) |
| *A43B 3/24* | (2006.01) |

(52) U.S. Cl.

CPC ..... *A43B 9/18* (2013.01); *A43B 3/0036* (2013.01); *A43B 3/108* (2013.01); *A43B 3/128* (2013.01); *A43B 9/00* (2013.01); *A43B 3/244* (2013.01)

(58) Field of Classification Search

CPC ..... A43B 3/108; A43B 3/128; A43B 3/244; A43B 9/18; A43B 9/00

USPC ..... 36/11.5, 12, 14, 15, 24.5, 100

See application file for complete search history.

(56) References Cited

U.S. PATENT DOCUMENTS

| | | | | |
|---|---|---|---|---|
| 4,317,294 | A | 3/1982 | Goodyear | |
| 6,023,859 | A * | 2/2000 | Burke et al. | 36/105 |
| 6,915,596 | B2 * | 7/2005 | Grove et al. | 36/100 |
| 7,010,872 | B2 * | 3/2006 | Pawlus et al. | 36/100 |
| 7,076,890 | B2 * | 7/2006 | Grove et al. | 36/15 |
| 7,140,129 | B2 * | 11/2006 | Newson et al. | 36/100 |
| 7,146,751 | B2 | 12/2006 | Seamans | |
| 7,290,357 | B2 | 11/2007 | McDonald et al. | |
| 7,320,188 | B2 | 1/2008 | Bathum | |

(Continued)

OTHER PUBLICATIONS

International Search Report and Written Opinion issued in PCT/US2012/035635, dated Jul. 10, 2012, 14 pages.

(Continued)

*Primary Examiner* — Sharon M Prange

(74) *Attorney, Agent, or Firm* — Wilmer Cutler Pickering Hale and Dorr LLP

(57) ABSTRACT

In some embodiments, a shoe assembly comprises a vamp and a sole. The vamp includes a middle section, and the vamp and the middle section are formed of a continuous piece of a first molded material. The vamp also includes a first aperture and a second aperture. The sole includes a forefoot section and a heel section that are joined by a midfoot section. The forefoot section, the heel section, and the midfoot section are formed of a continuous piece of a second molded material. The second molded material is an EVA-based material. The first aperture of the vamp receives a part of the forefoot section and the second aperture receives a part of the heel section. When the shoe assembly is placed on a flat surface, the forefoot section is in direct contact with the flat surface.

25 Claims, 46 Drawing Sheets

(56) References Cited

U.S. PATENT DOCUMENTS

| | | | | |
|---|---|---|---|---|
| 7,451,557 | B2 * | 11/2008 | McDonald et al. | 36/100 |
| 8,240,067 | B2 * | 8/2012 | Sussmann | 36/103 |
| 8,307,570 | B2 * | 11/2012 | Delgatty | 36/100 |
| 2009/0044428 | A1 * | 2/2009 | Bernardeschi | A43B 9/00 36/103 |

OTHER PUBLICATIONS

Adidas F50.8 TUNiT overview by Footy Boots, available Feb. 14, 2008; retrieved from www.footy-boots.com/adidas-f508-tunit/ on Dec. 12, 2014.

Photos of Adidas F50.9 TUNiT shoe upper (shoe upper available more than one year prior to the filing date of the present application).

Photos of Columbia Sierra Flurry™ 2 boot (boot available more than one year prior to the filing date of the present application).

Photos of Rider Spree sandal (sandal available more than one year prior to the filing date of the present application).

* cited by examiner

FOOTWEAR WITH DUAL MOLDED PIECE CONSTRUCTION

CROSS-REFERENCE TO RELATED APPLICATIONS

This application claims the benefit of U.S. Provisional Patent Application Ser. No. 61/481,083, filed Apr. 29, 2011 and U.S. Provisional Patent Application Ser. No. 61/547,529, filed Oct. 14, 2011, both of which are incorporated herein by reference in their entireties for all purposes.

TECHNICAL FIELD

Various embodiments of the present invention generally relate to footwear. More specifically, embodiments of the present invention relate to footwear made of two different molded materials.

BACKGROUND

Many shoes incorporate an EVA-based material because of the comfort, durability, and other benefits that an EVA-based material offers. Other materials, such as thermoplastic polyurethane, provide other desired characteristics in durability and appearance.

SUMMARY

According to several embodiments of the invention, a shoe assembly includes a vamp and a sole. The sole is snapped into the vamp by pushing portions of the sole into apertures formed in the vamp. In one embodiment, for example, the vamp includes a middle section, and the vamp and the middle section may be formed of a continuous piece of a first molded material. The vamp also includes a first aperture and a second aperture. The sole includes a forefoot section and a heel section that are joined by a midfoot section. The forefoot section, the heel section, and the midfoot section are formed of a continuous piece of a second molded material. The second molded material may be an EVA-based material. The first aperture of the vamp receives a part of the forefoot section and the second aperture receives a part of the heel section. When the shoe assembly is placed on a flat surface, at least the forefoot section is in direct contact with the flat surface, according to embodiments of the present invention.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
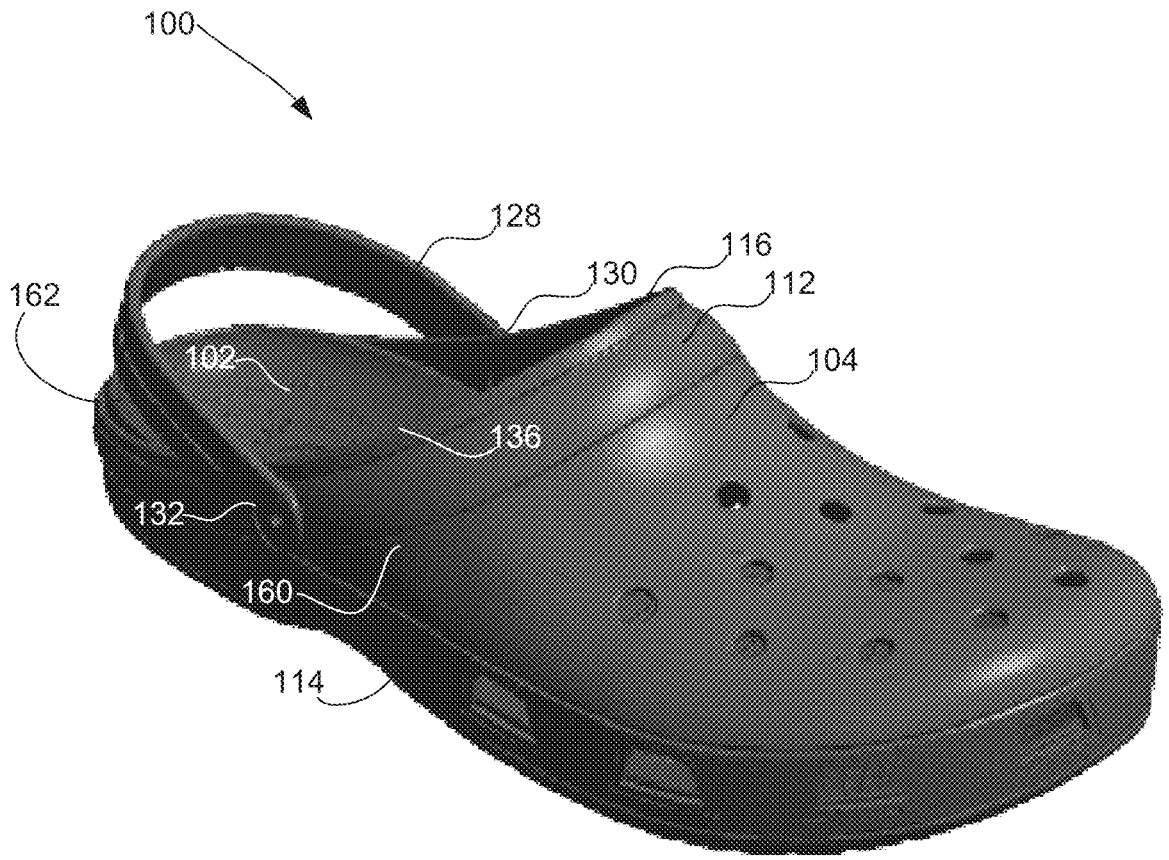
FIG. 1 illustrates a perspective view of a shoe assembly according to embodiments of the present invention.
Figure 2:
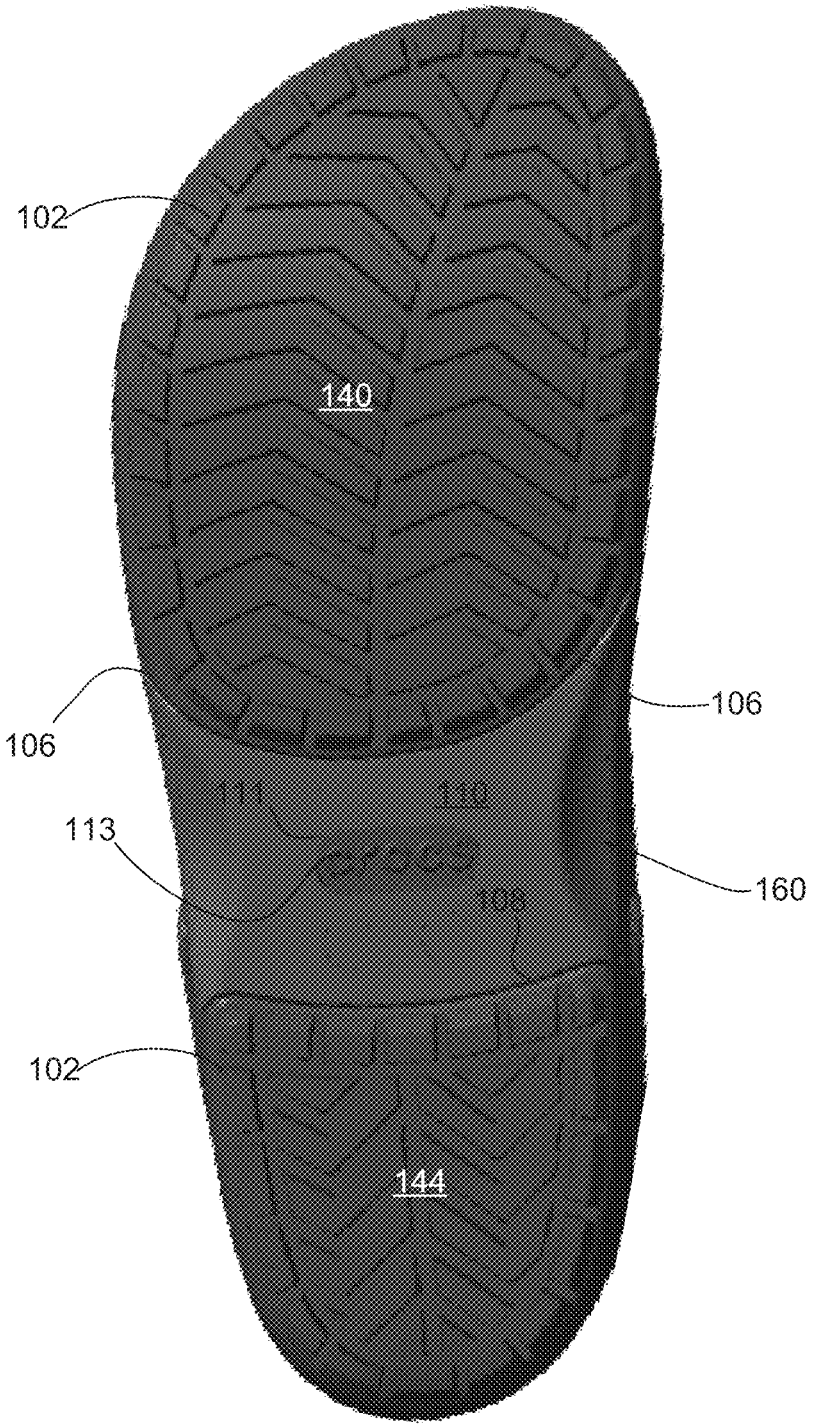
FIG. 2 illustrates a bottom view of the shoe assembly of FIG. 1.
Figure 3:
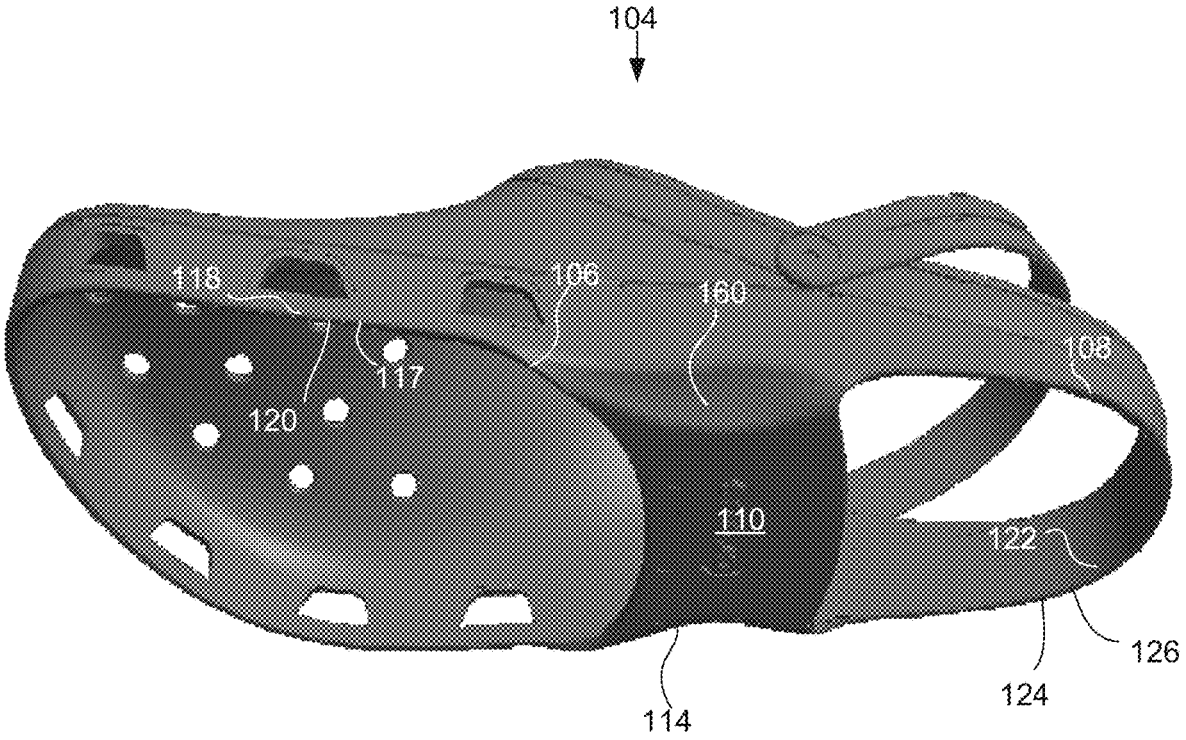
FIG. 3 illustrates a lower perspective view of a vamp according to embodiments of the present invention.

FIG. 1 illustrates a shoe 100 according to embodiments of the invention. The shoe comprises a sole 102 that is inserted into a vamp 104. As seen in FIGS. 2 and 3, in some embodiments the vamp 104 includes one or more apertures 106, 108 that receive portions (140, 144) of the sole 102. The vamp 104 may also include one or more sections, such as middle section 110, that wrap around the sole 102, for example, to add support. The middle section 110 may include a middle section aperture 111 through which a middle section portion 113 of the sole 102 may extend. In other embodiments, the middle section portion 113 does not extend into the middle section aperture 111 but may be seen through the middle section aperture 111. To construct the shoe 100, the sole 102 may be placed into the vamp 104 and snapped into place, such that the sole 102 and vamp 104 are coupled in a snap-through or push-through construction. In some embodiments, the sole 102 and the vamp 104 may be cemented together in an adhering relationship.

The vamp 104 may be formed of a single continuous piece of thermoplastic polyurethane (TPU) or other similar materials. The vamp 104 may be formed by injection molding or by press molding. According to some embodiments, as shown in FIG. 1, the vamp 104 has an upper surface 112 and a lower surface 114. The upper surface 112 may include a foot opening 116 through which a user may insert a foot. In some embodiments, the vamp 104 includes a strap 128 formed of TPU. The ends of the strap 130, 132 may be secured, for example with rivets, to the upper surface 112 of the vamp 104 near the perimeter 136 of the foot opening 116.

As shown in FIG. 3, the lower surface 114 may include a forefoot sole aperture 106 having an inner forefoot sole aperture perimeter 117, an outer forefoot sole aperture perimeter 118, and a lower forefoot sole aperture perimeter surface 120. The lower surface 114 may also include a heel sole aperture 108 having an inner heel sole aperture perimeter 122, an outer heel sole aperture perimeter 124, and a lower heel sole aperture perimeter surface 126. The forefoot sole aperture 106 and the heel sole aperture 108 may be separated by a middle section 110. In some embodiments, the middle section 110 is formed continuously with the rest of the vamp 104. In some embodiments of the present invention, the middle section 110 adds support to the sole 102 when inserted into the vamp 104, and/or provides a more durable mechanical connection between vamp 104 and sole 102. The middle section 110, in combination with the upper surface 112 of the vamp 104, may form a continuous band 160.

Figure 4:
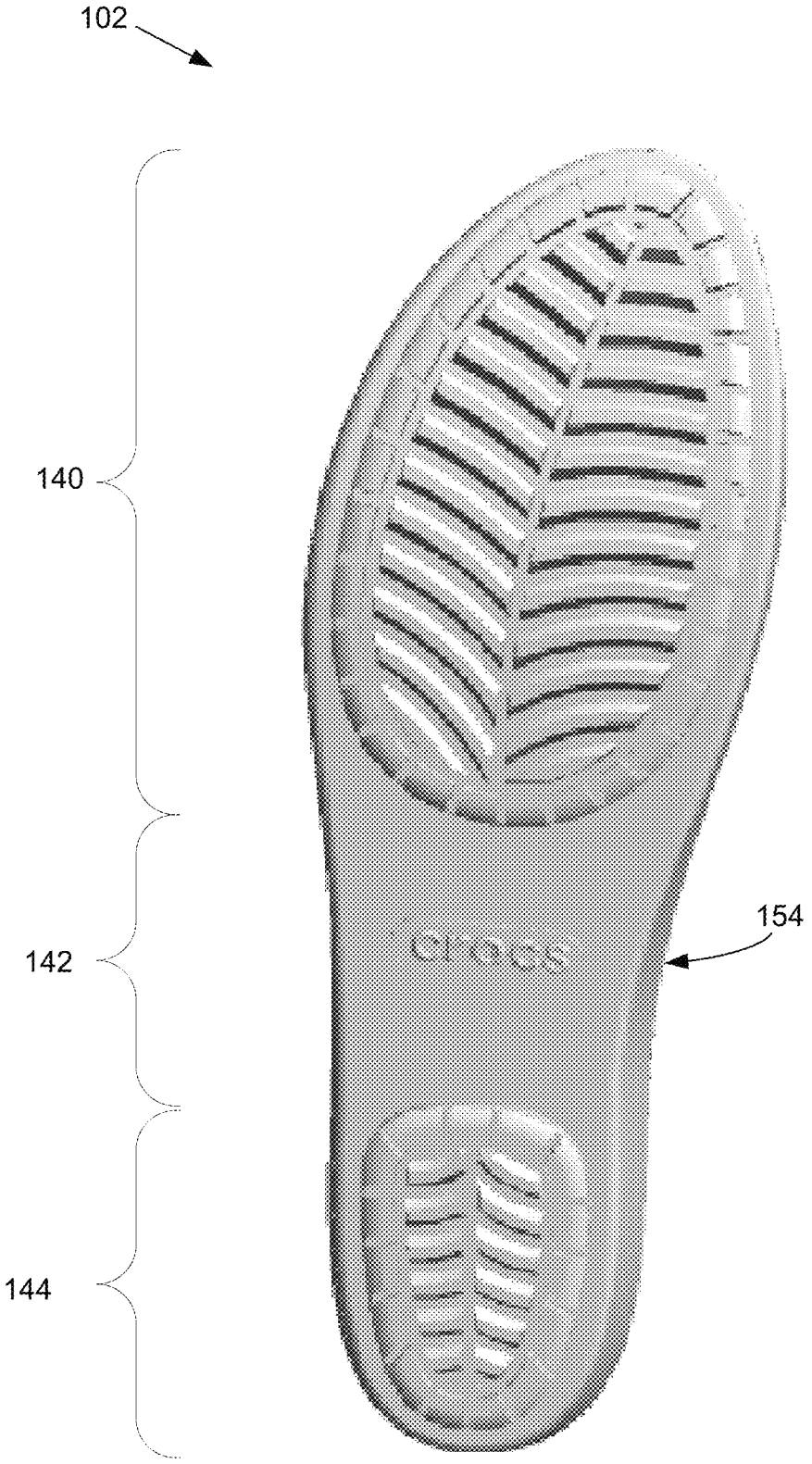
FIG. 4 illustrates a bottom view of a sole according to embodiments of the present invention.
Figure 5:
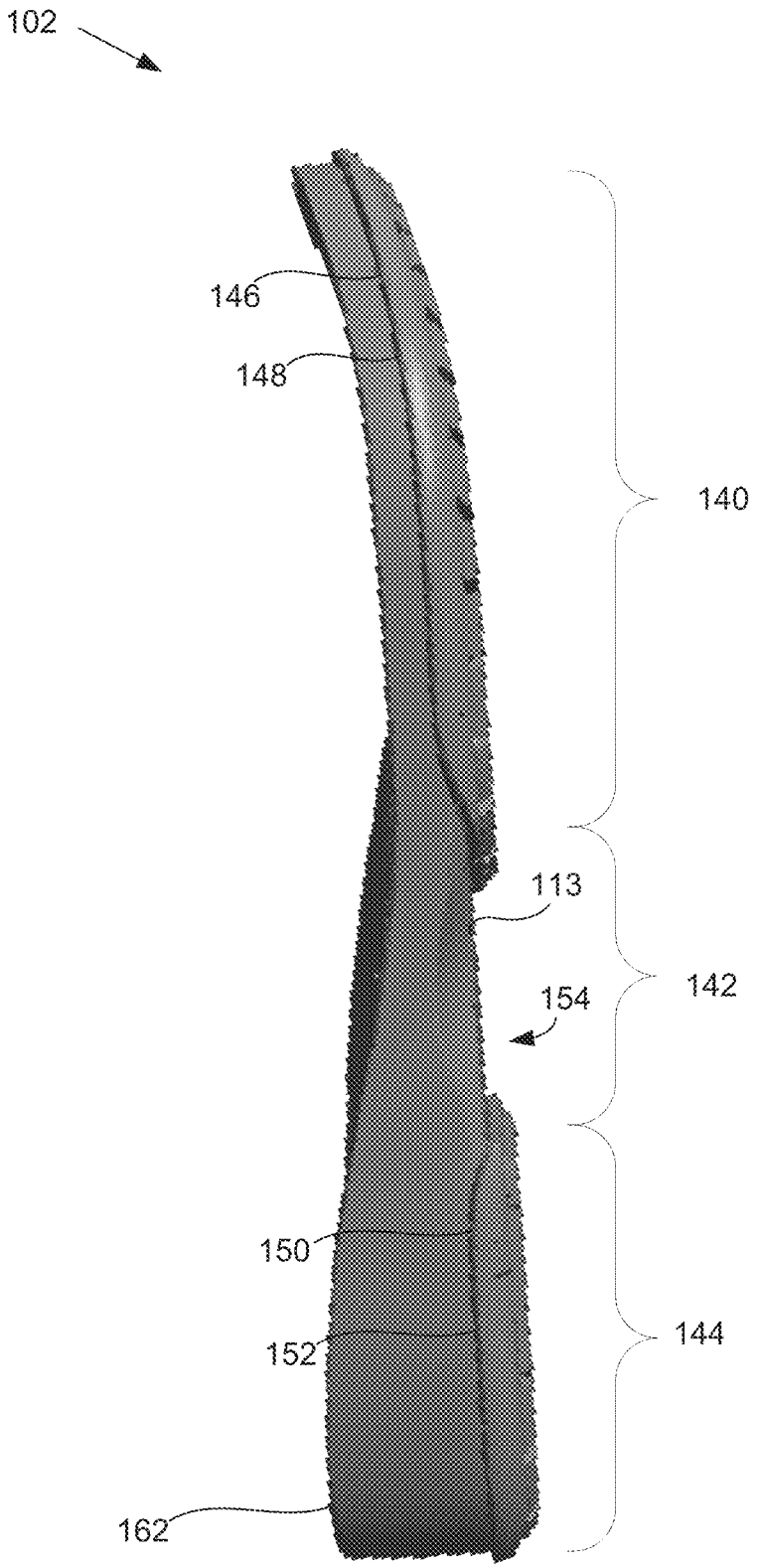
FIG. 5 illustrates a side view of a sole according to embodiments of the present invention.
Figure 6:
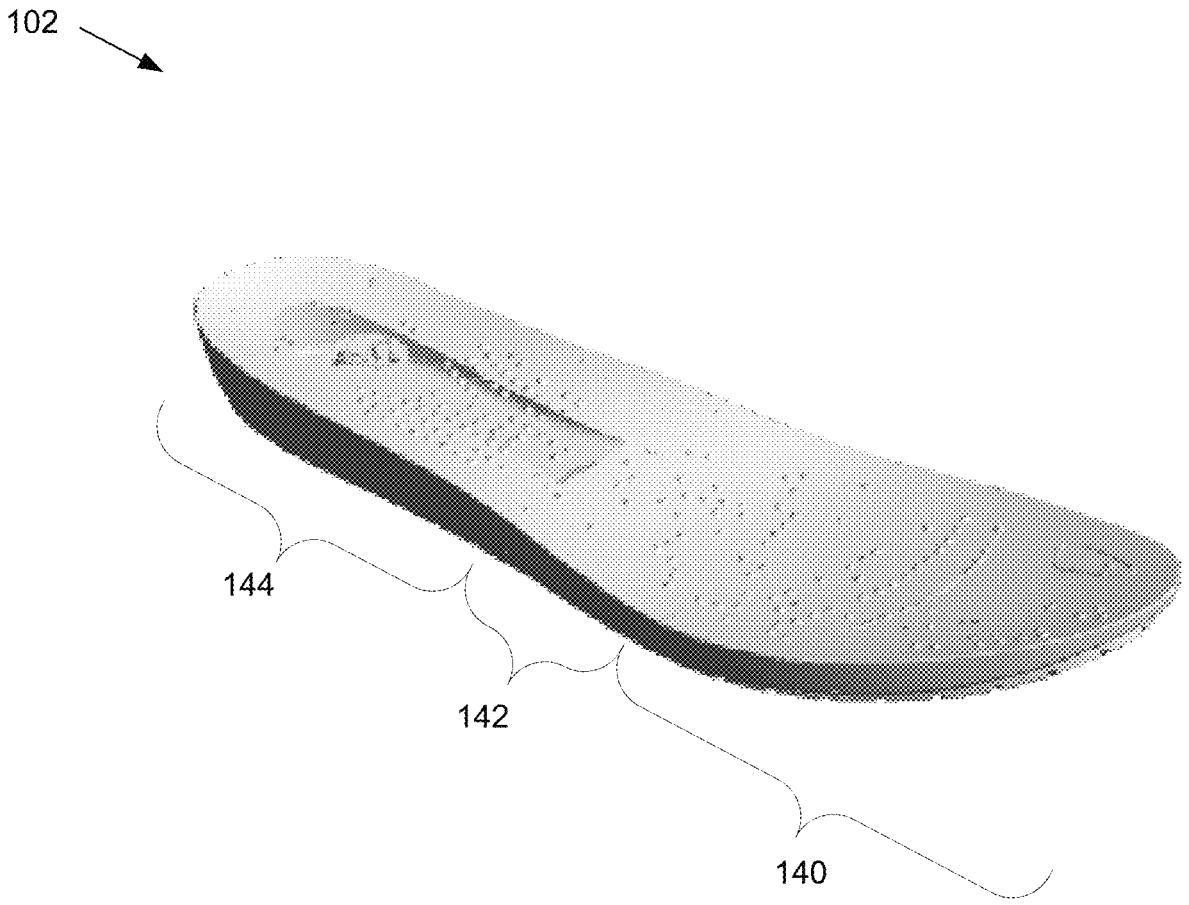
FIG. 6 illustrates a perspective view of the sole of FIG. 4.
Figure 20:
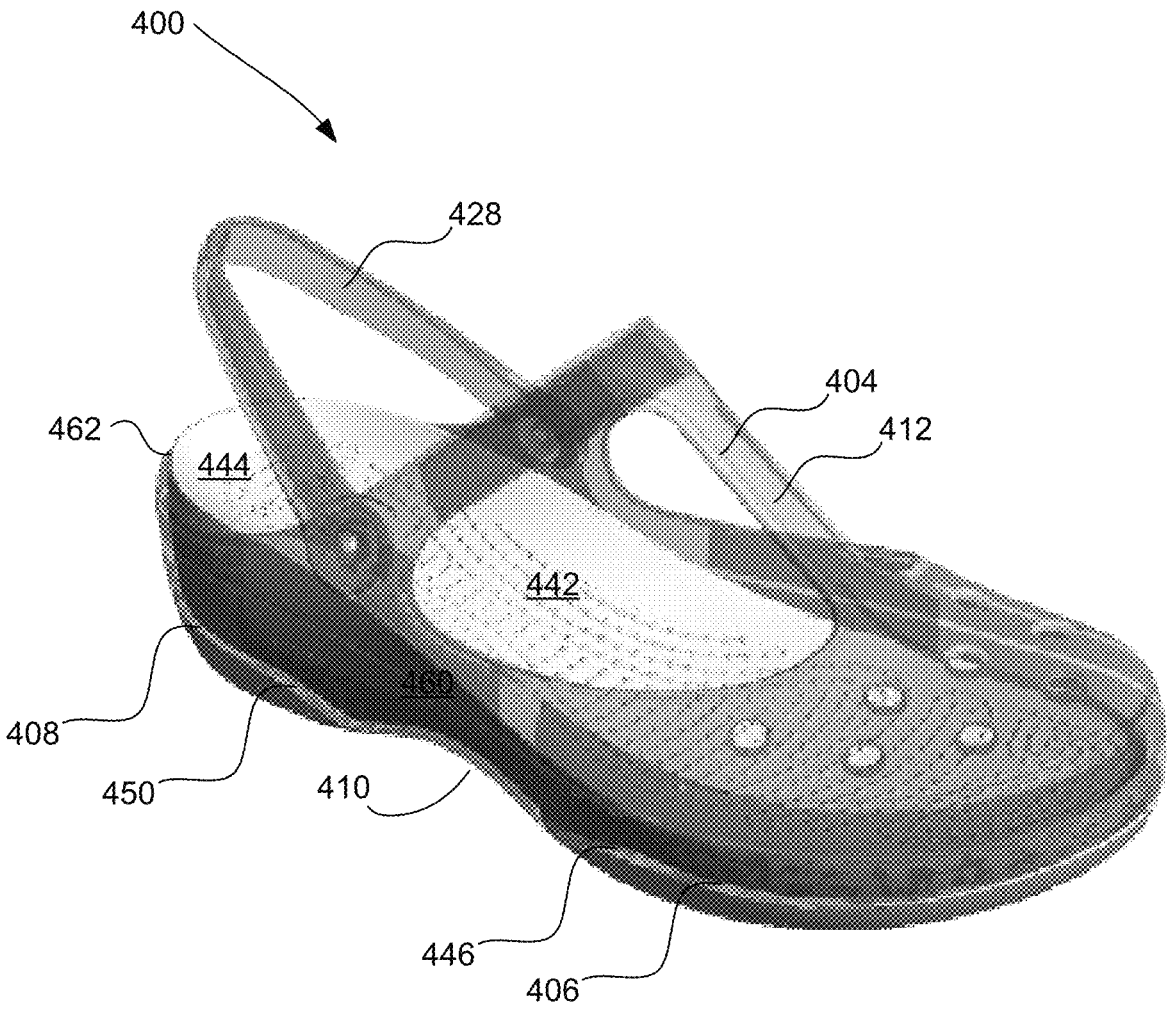
FIG. 20 illustrates a perspective view of the shoe assembly of FIG. 16.
Figure 21:
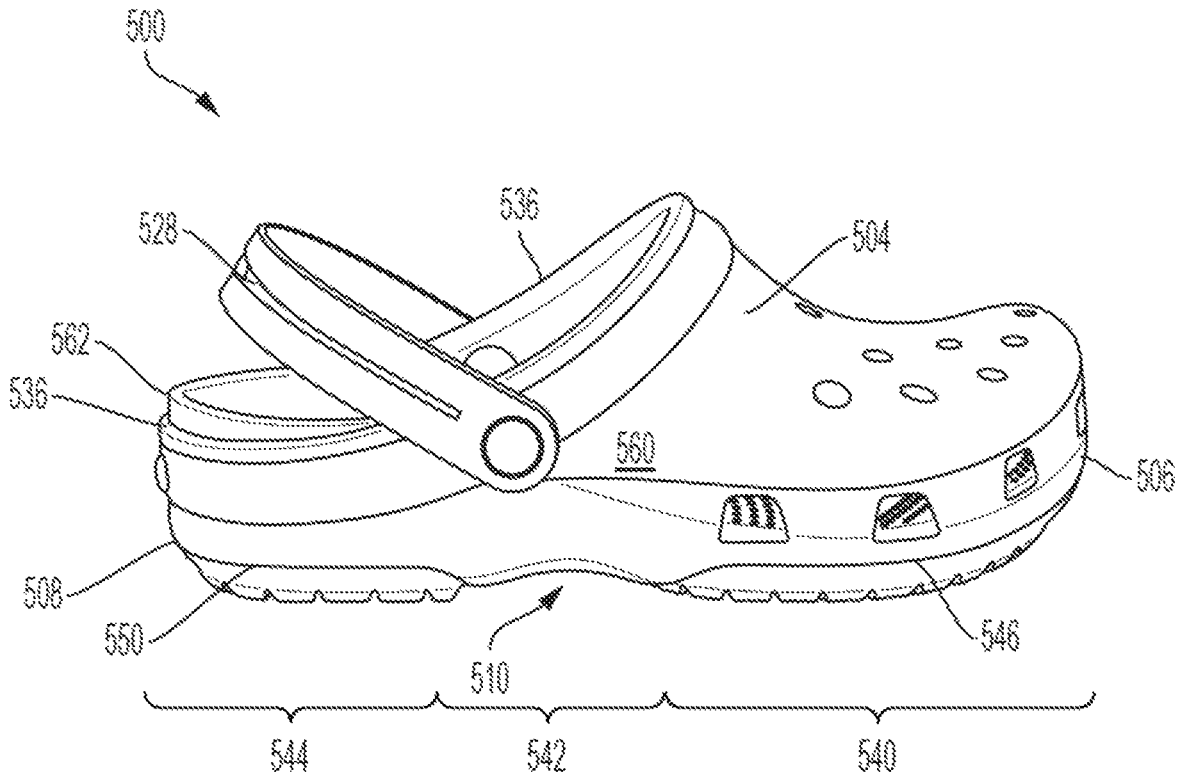
FIG. 21 illustrates a side view of a shoe assembly according to embodiments of the present invention.
Figure 22:
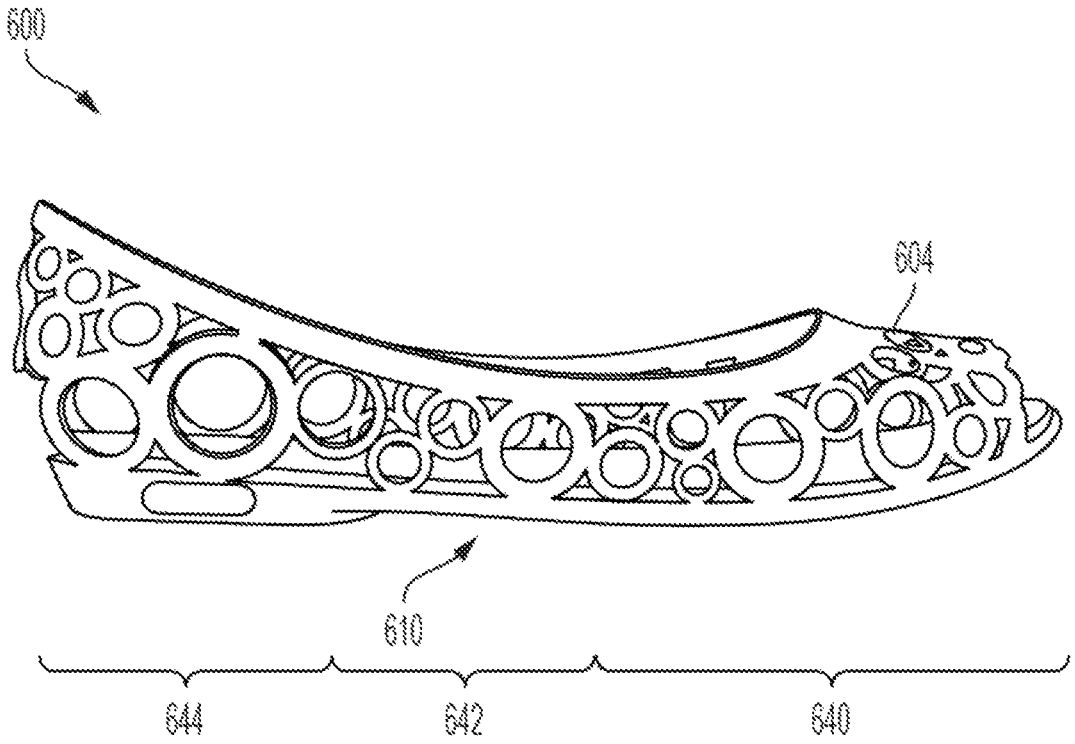
FIG. 22 illustrates a side view of a shoe assembly according to embodiments of the present invention.
Figure 23:
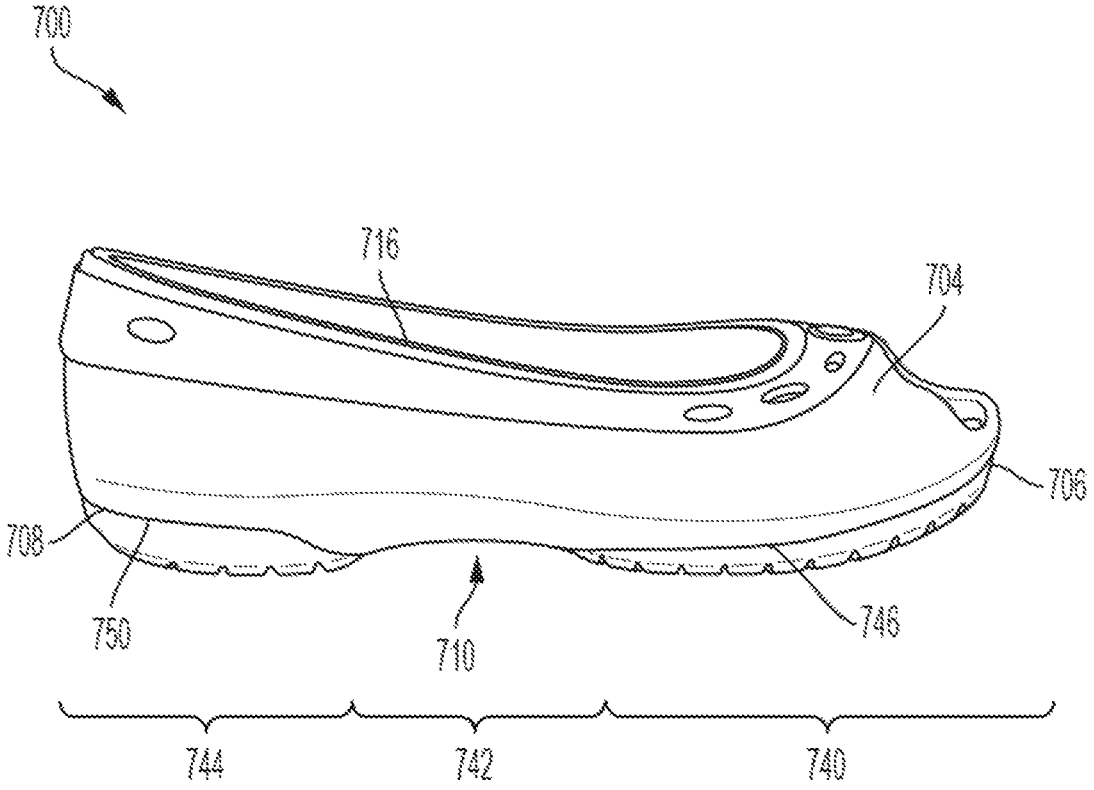
FIG. 23 illustrates a side view of a shoe assembly according to embodiments of the present invention.
Figure 24:
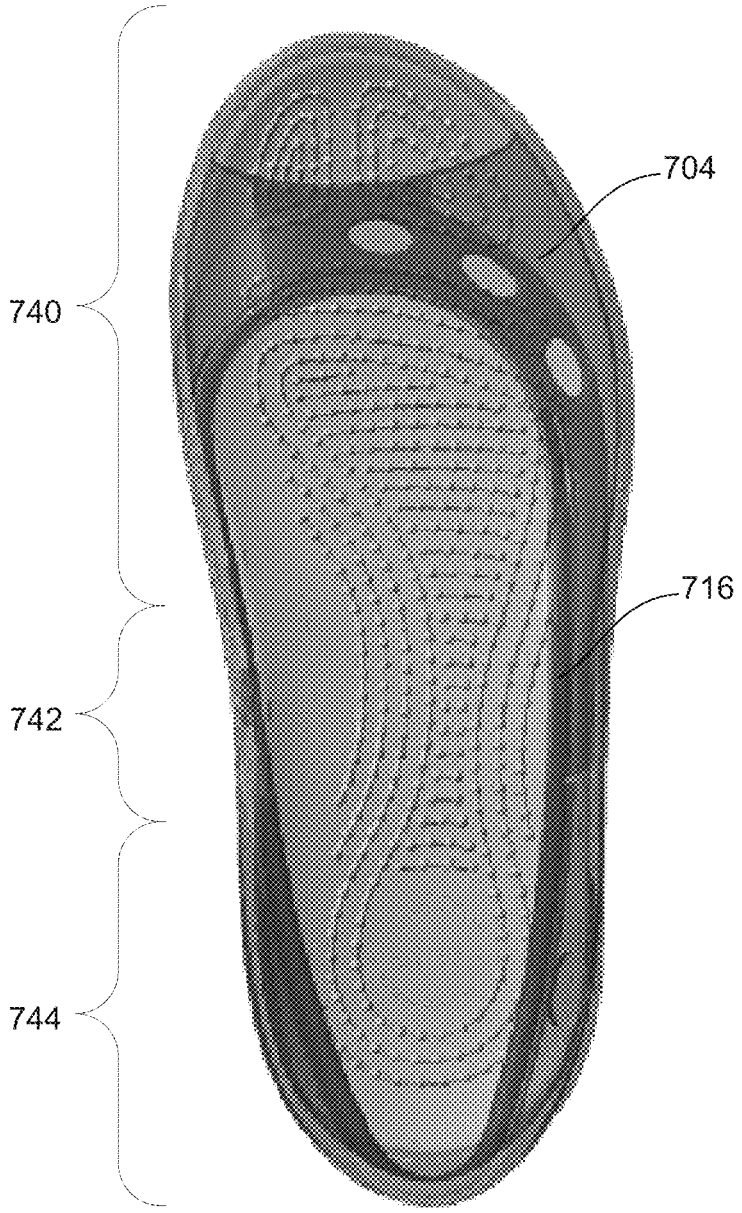
FIG. 24 illustrates a top view of the shoe assembly of FIG. 23.
Figure 25:
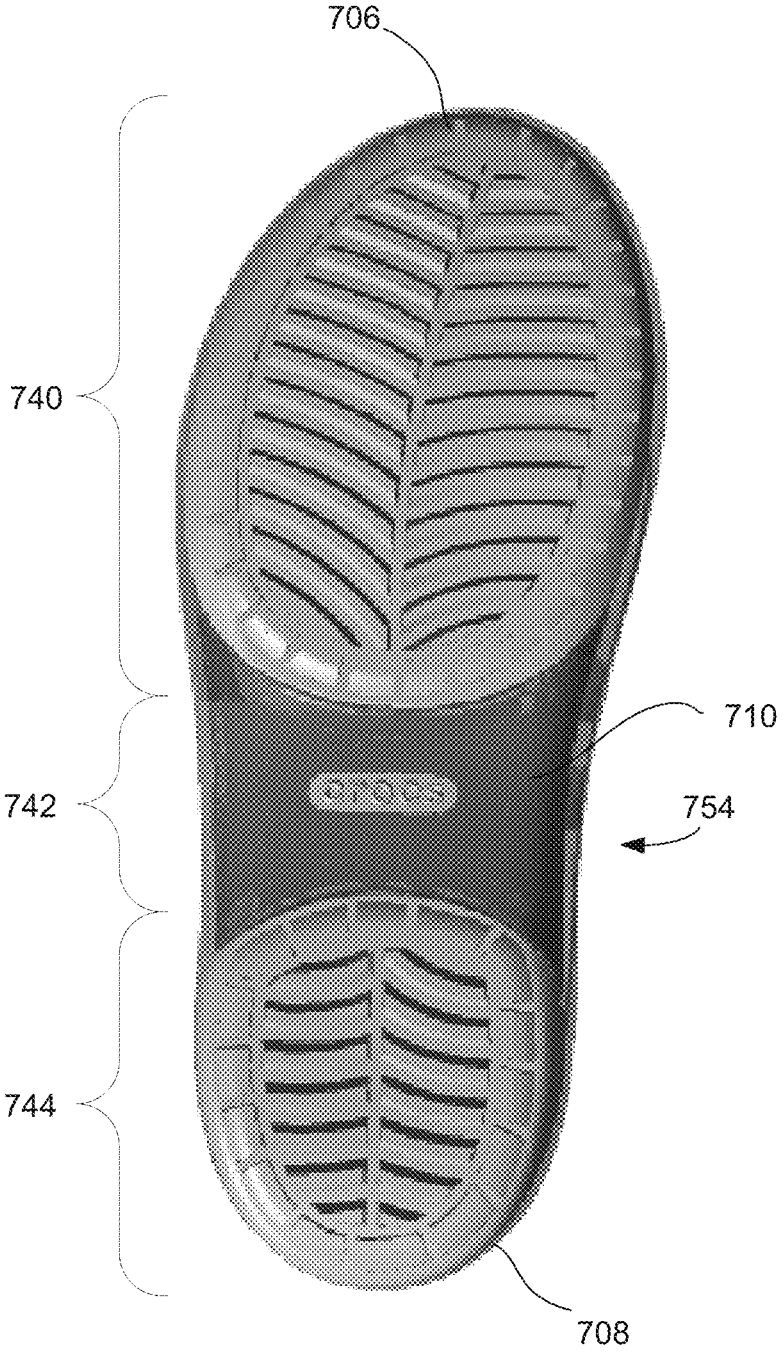
FIG. 25 illustrates a bottom view of the shoe assembly of FIG. 23.
Figure 26:
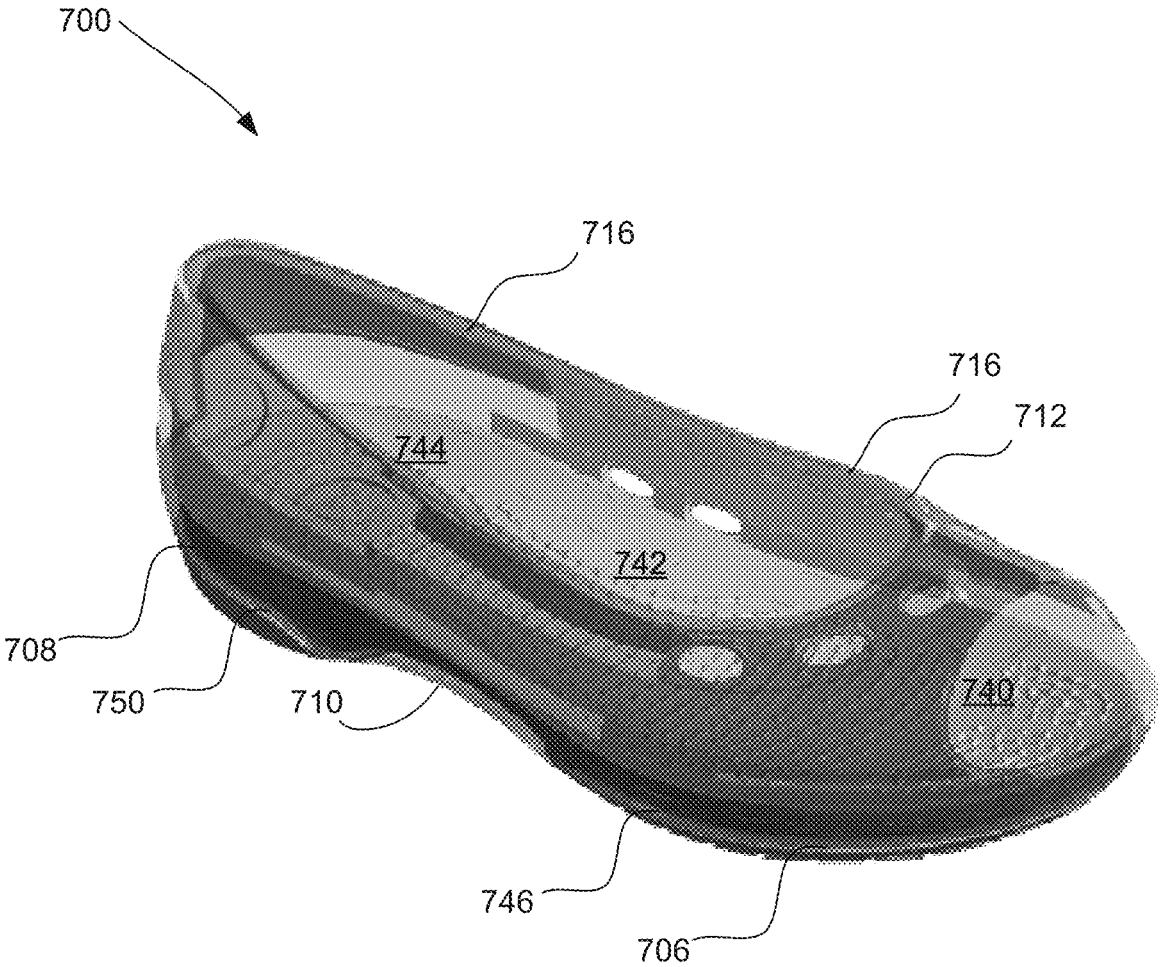
FIG. 26 illustrates a perspective view of the shoe assembly of FIG. 23.
Figure 27:
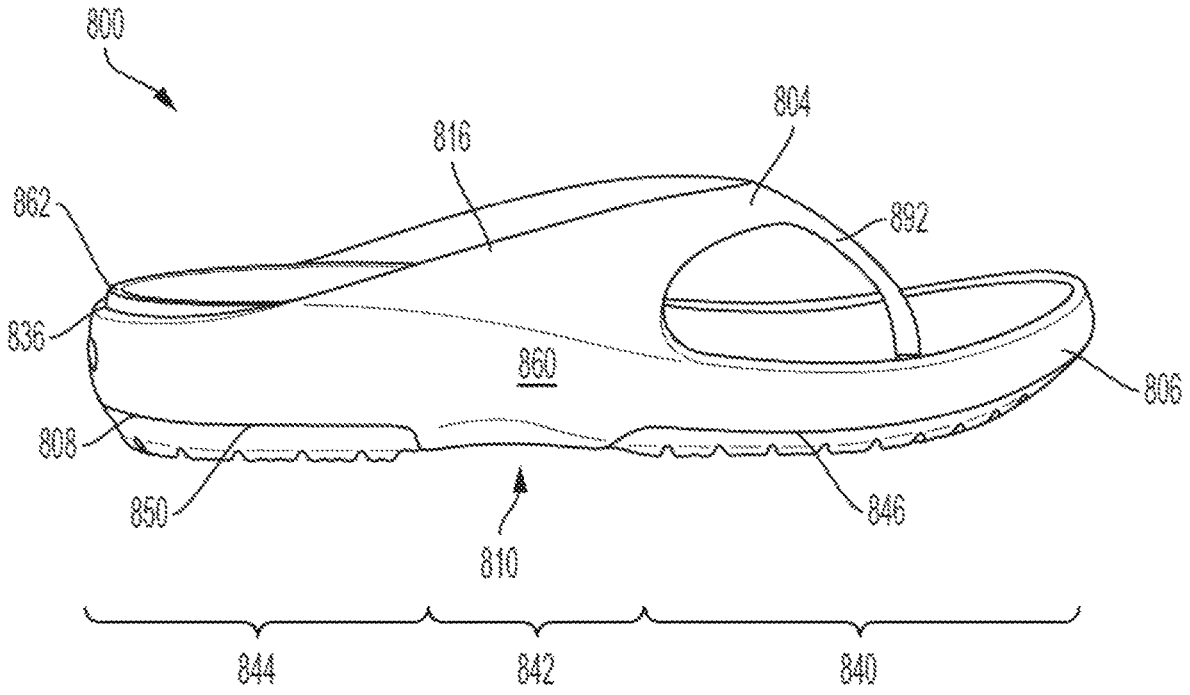
FIG. 27 illustrates a side view of a shoe assembly according to embodiments of the present invention.
Figure 28:
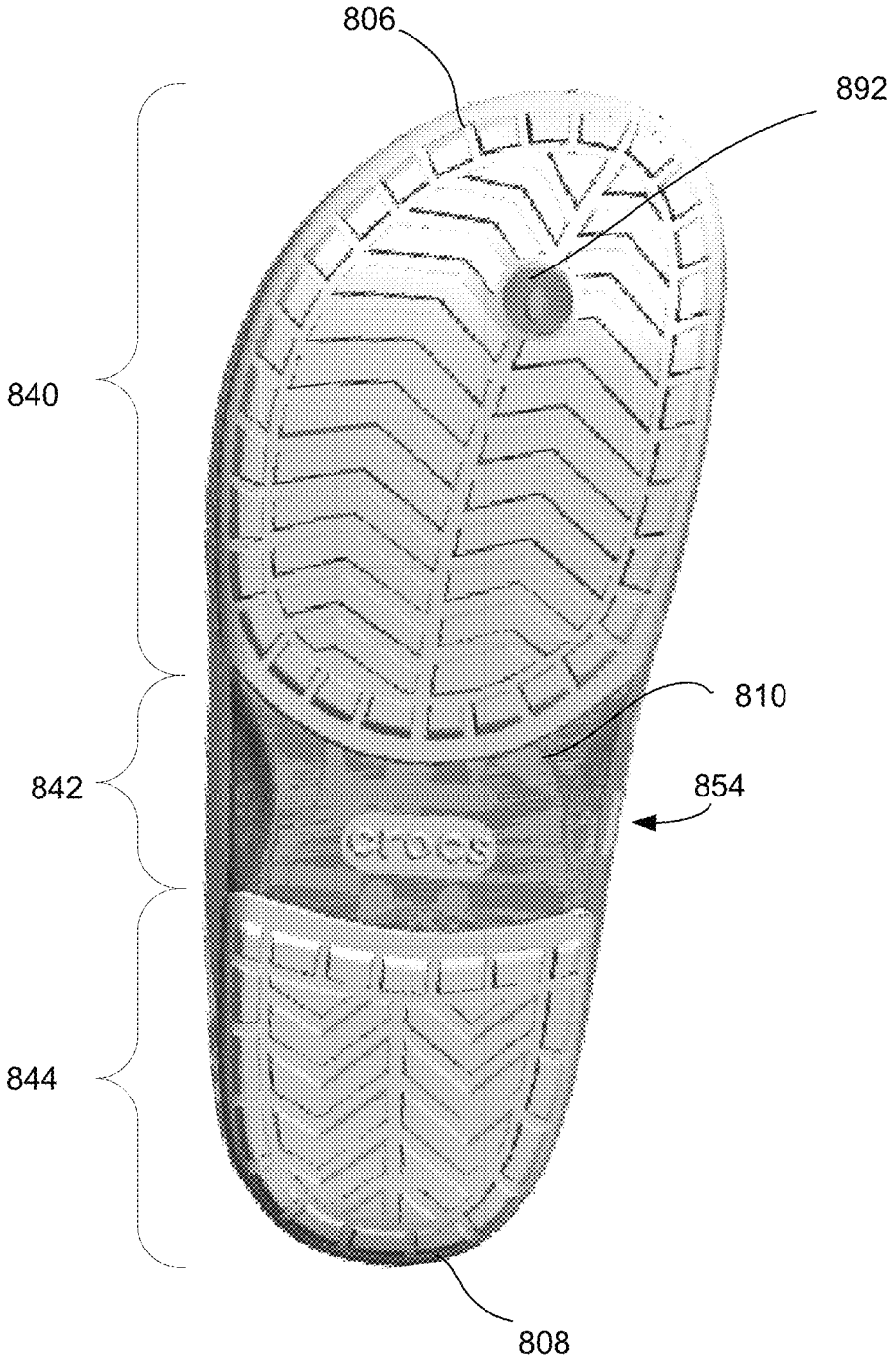
FIG. 28 illustrates a bottom view of the shoe assembly of FIG. 27.
Figure 29:
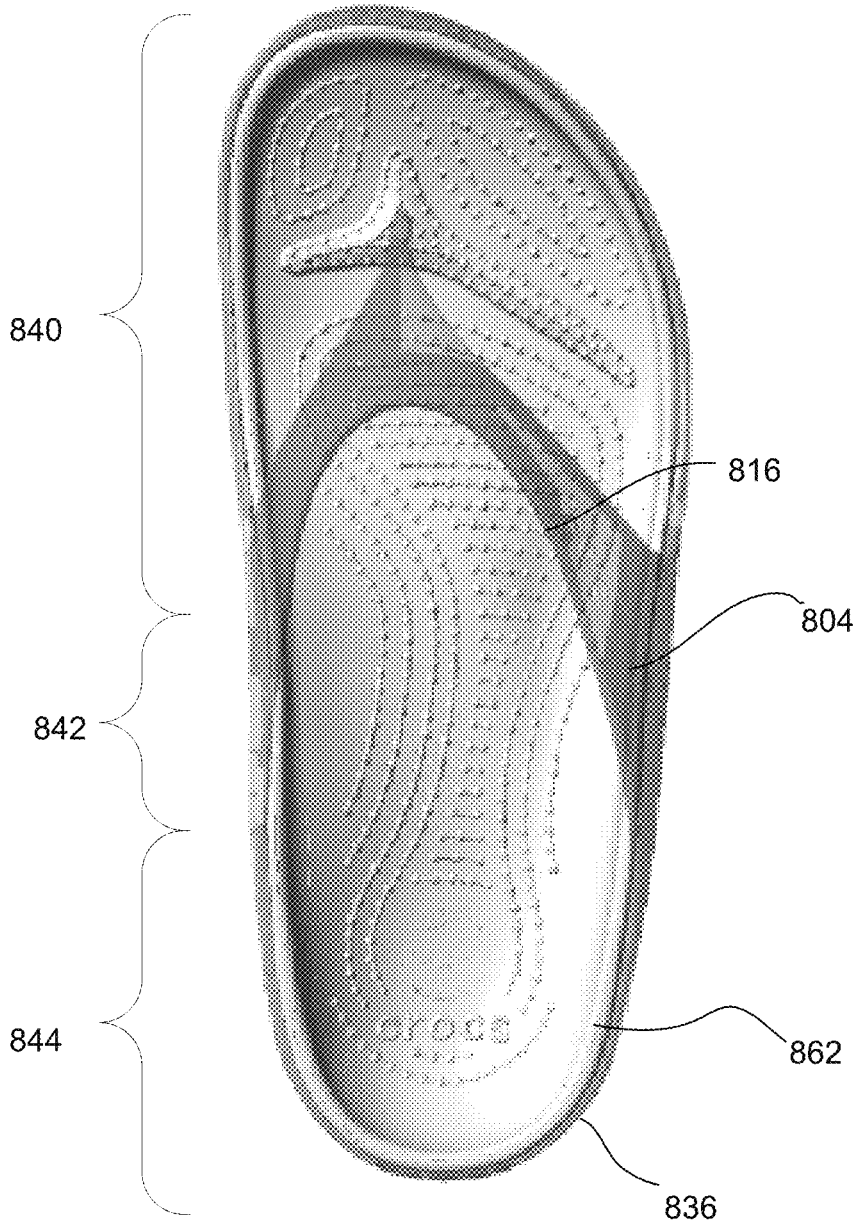
FIG. 29 illustrates a top view of the shoe assembly of FIG. 27.
Figure 30:
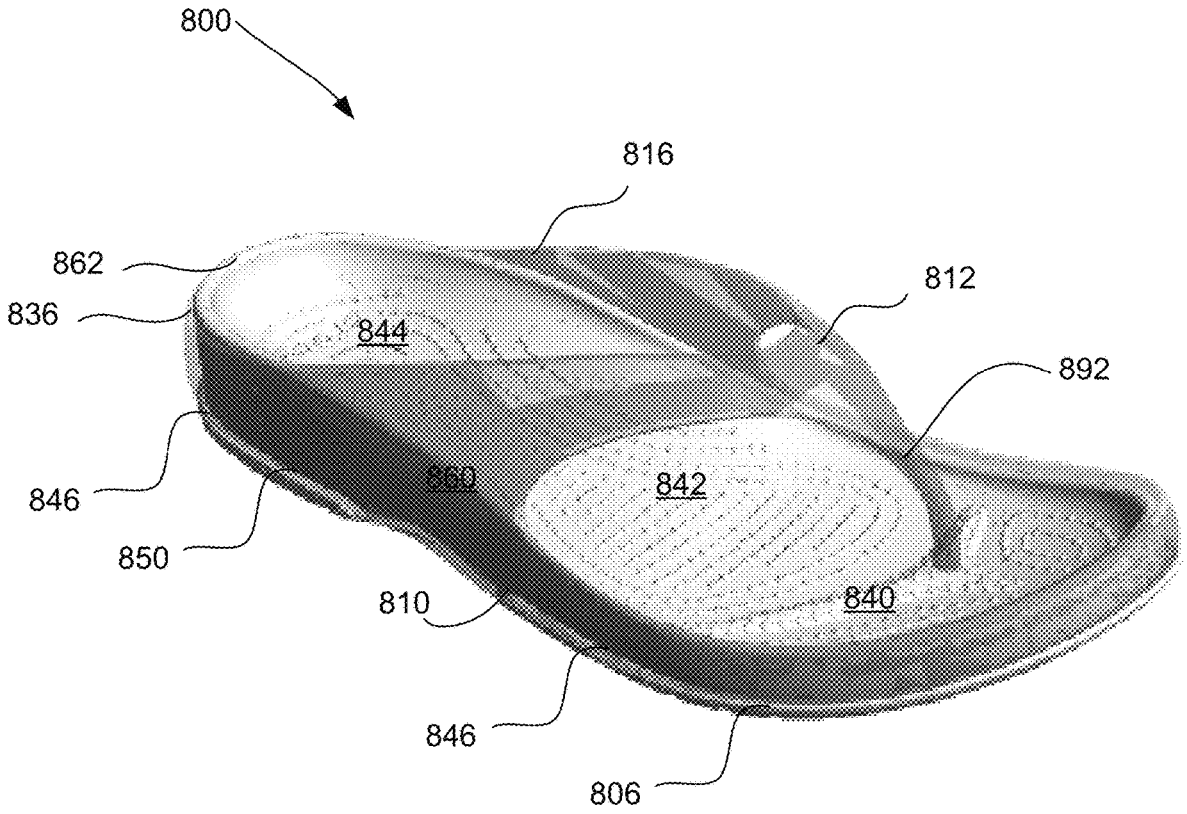
FIG. 30 illustrates a perspective view of the shoe assembly of FIG. 27.
Figure 31:
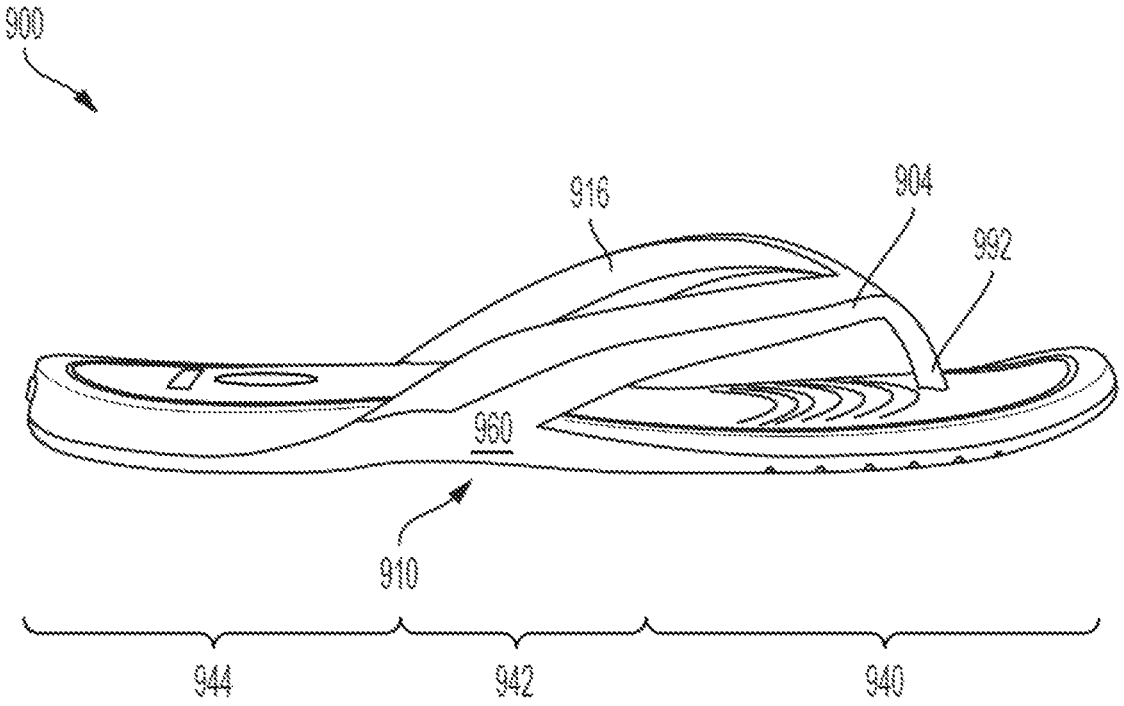
FIG. 31 illustrates a side view of a shoe assembly according to embodiments of the present invention.
Figure 32:
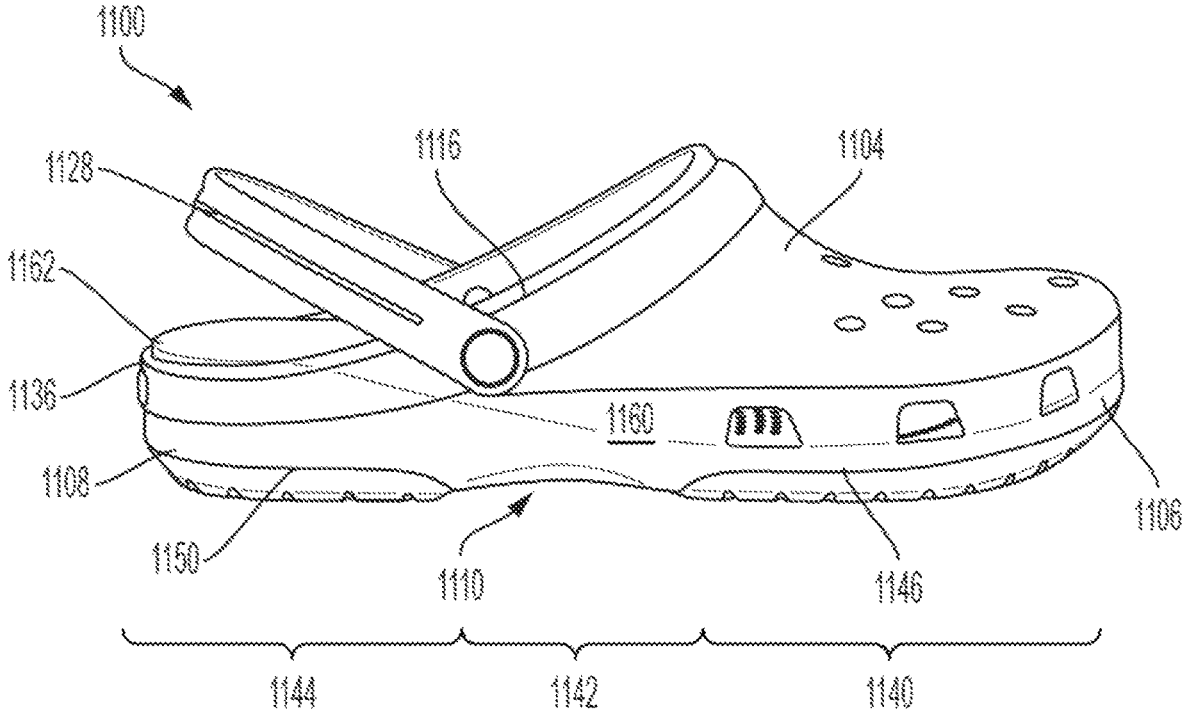
FIG. 32 illustrates a side view of a shoe assembly according to embodiments of the present invention.

As shown in FIG. 4, the sole 102 includes a forefoot portion 140, a midfoot portion 142, and a heel portion 144. The sole 102 may be formed of an EVA-based material, and the forefoot portion 140, the midfoot portion 142, and the heel portion 144 may be formed of a continuous piece of molded material. The forefoot portion 140, midfoot portion 142, and heel portion 144 may be formed by injection molding or by press molding. In some embodiments, the forefoot portion 140 includes a forefoot ridge 146, as shown in FIG. 5. The forefoot ridge 146 may extend around the entire outer perimeter 148 of the forefoot portion 140 or the forefoot ridge 146 may extend over only a portion of the outer perimeter 148 of the forefoot portion 140. In some embodiments, the forefoot ridge 146 helps to snap the sole 102 into the vamp 104 when the shoe 100 is assembled. Similarly, the sole 102 may include a heel ridge 150. The heel ridge 150 may extend around the entire outer perimeter 152 of the heel portion 144 or the heel ridge 150 may extend over only a portion of the outer perimeter 152 of the heel portion 144. As with the forefoot ridge 146, the heel ridge 150 may help snap the sole 102 into the vamp 104 when the shoe 100 is assembled. The embodiments shown in FIG. 20 also illustrate a forefoot ridge 446 and a heel ridge 450.

The sole 100 also includes a midfoot portion 142. In some embodiments, a midsole channel 154 is formed between the forefoot portion 140 and the heel portion 144, for example as a substantially flat section spanning the forefoot portion 140 and the heel portion 144, as illustrated in FIG. 4. In some embodiments, the midsole channel 154 is configured to receive the middle section 110 of the vamp 104 when the sole 102 and the vamp 104 are placed together, so that the middle section 110 may lie alongside the forefoot portion 140 and the heel portion 144. In other embodiments, the middle section 110 is received within the midsole channel 154 without touching the forefoot portion 140 or the heel portion 144. The middle section 110, along with the upper surface 114 of the vamp 104, forms a continuous band 160 that surrounds portions of the sole 102, such as the midfoot portion 142. Having a continuous band 160 encircling portions of the sole 102 strengthens the shoe 100 by enabling the transfer of forces from the sole 102 to the vamp 104 without utilizing seams that may rupture under pressure. In addition, the midsole channel 154 and the middle section 110 of the vamp 104 may be secured by an adhesive, for example glue, for added stability.

Figure 33:
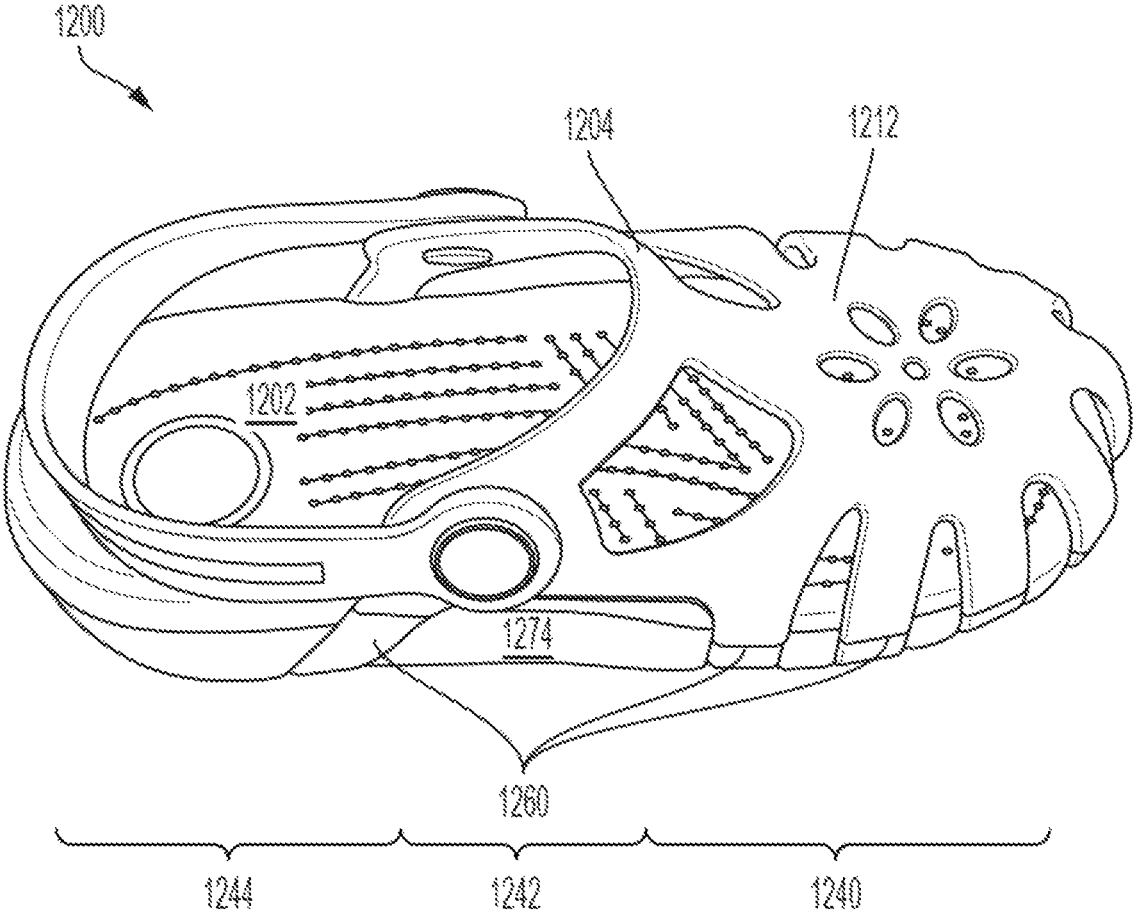
FIG. 33 illustrates a side perspective view of a shoe assembly according to embodiments of the present invention.
Figure 34:
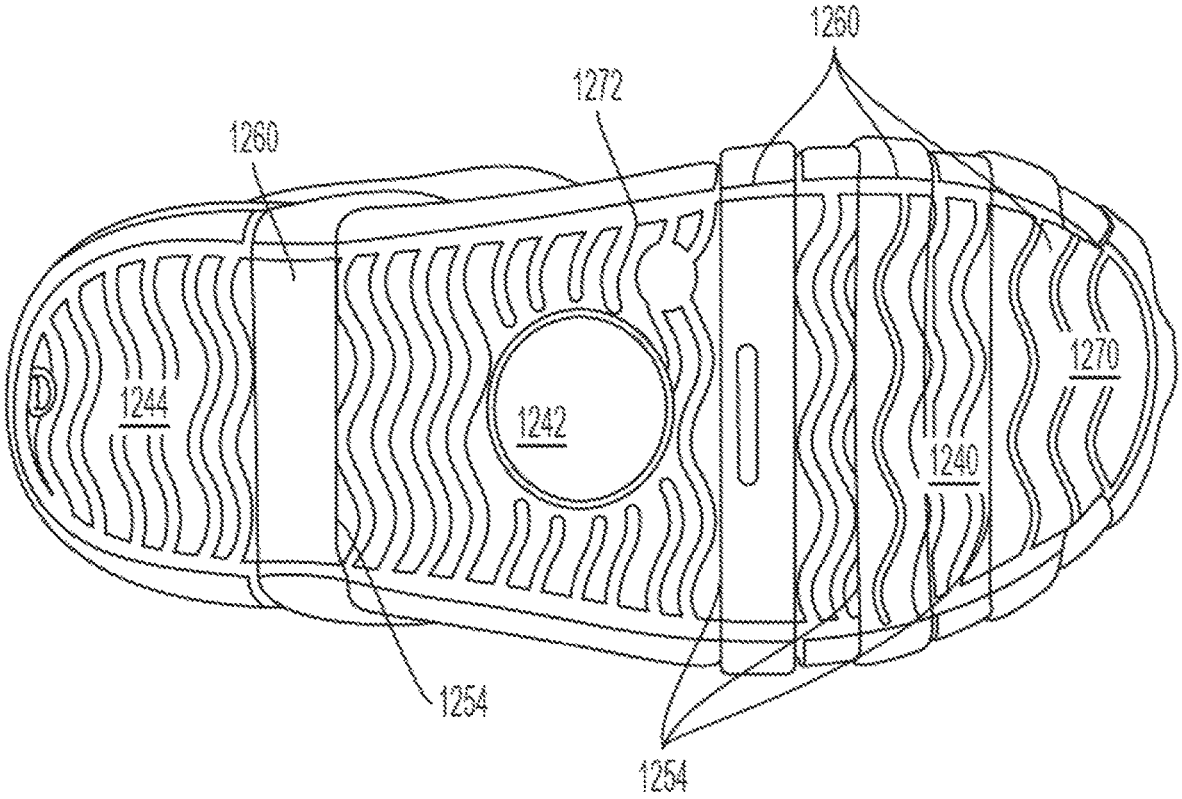
FIG. 34 illustrates a bottom view of the shoe assembly of FIG. 33.
Figure 35:
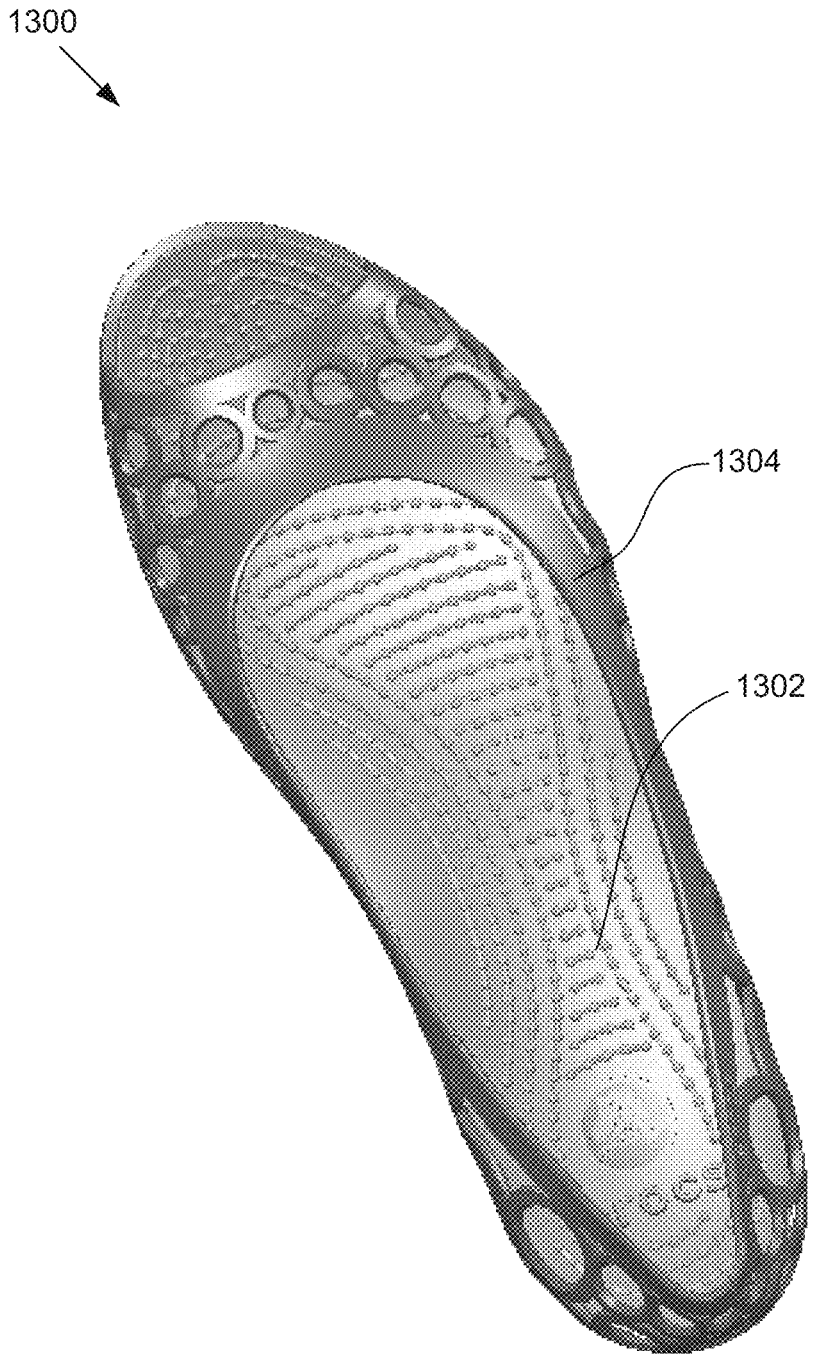
FIG. 35 illustrates a top view of a shoe assembly according to embodiments of the present invention.
Figure 36:
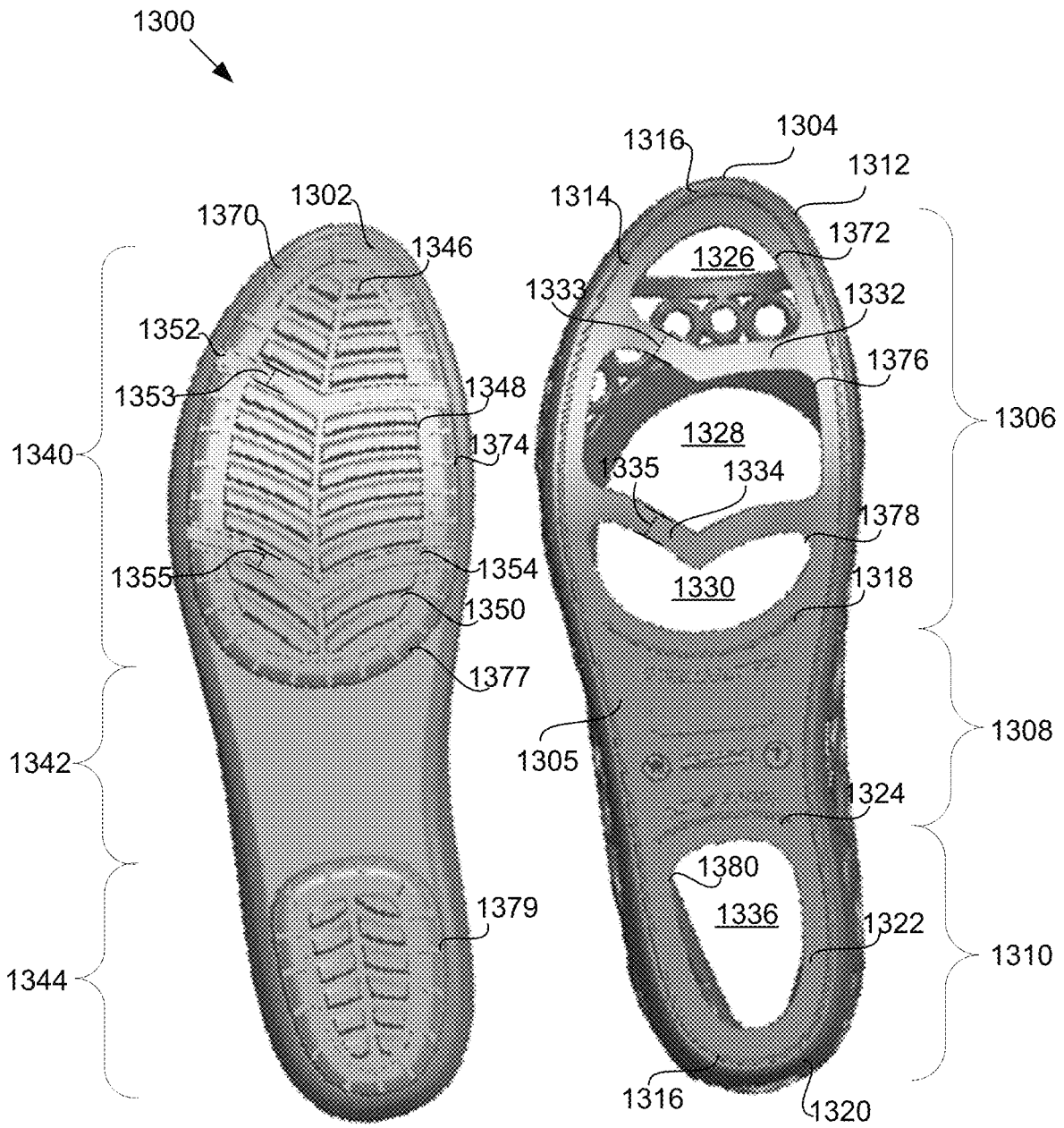
FIG. 36 illustrates a bottom view of a sole and a vamp of the shoe assembly of FIG. 35.

The midsole channel 154 receives the middle section 110 of the vamp 104, in order to assist in securing the sole 102 to the vamp 104. In other embodiments, as illustrated in FIGS. 33 and 34, the sole 102 may include a plurality of channels 1254.

To construct the shoe 100, the sole 102 is inserted through the foot opening 116. The forefoot portion 140 is pressed into the forefoot sole aperture 106 until the forefoot ridge 146 is pushed past the inner forefoot aperture perimeter 117. In some embodiments, the forefoot ridge 146 has approximately the same dimensions and configuration as the outer forefoot aperture perimeter 118, or may be larger than the outer forefoot aperture perimeter 118. In those embodiments, when the forefoot portion 140 is pressed into the forefoot sole aperture 106, the EVA-based material of the sole 102 may compress and/or the material of the vamp 104 may stretch as the wider forefoot ridge 146 passes through the smaller inner forefoot aperture perimeter 117. Once the forefoot ridge 146 is pushed beyond the inner forefoot perimeter 117, the EVA-based material and/or the vamp material revert back to their original dimensions, or if stretched, exhibit a biasing force against one another. In some embodiments, the interaction between the forefoot ridge 146 and the inner forefoot aperture perimeter 117 constitute a snap configuration. In many embodiments, the forefoot ridge 146 lies directly below at least part of the lower forefoot sole aperture perimeter surface 120. That configuration adds increased stability and strength as downward forces on the vamp 104 and/or upward forces on the sole 102 will press the sole 102 and the vamp 104 together. In some embodiments, an adhesive is applied at the interface of the forefoot portion 140 and the forefoot sole aperture 106, for example, on the forefoot ridge 146 and/or inner forefoot aperture perimeter 117.

The heel portion 144 and the heel sole aperture 108 may be similarly constructed. Thus, in some embodiments, the heel ridge 150 has approximately the same dimensions and configuration as the outer heel aperture perimeter 124, or may be larger than the outer heel aperture perimeter 124. In those embodiments, when the heel portion 144 is pressed into the heel sole aperture 108, the EVA-based material of the sole 102 may contract and/or the material of the vamp 104 may slightly stretch as the wider heel ridge 150 passes through the smaller inner heel aperture perimeter 122. Once the heel ridge 150 is pushed beyond the inner heel perimeter 122, the EVA-based material and/or the vamp material will revert back to their original dimensions, or if stretched, exhibit a biasing force against one another. In those embodiments, the heel ridge 150 lies directly below at least part of the lower heel sole aperture perimeter surface 126. That configuration adds increased stability and strength as downward forces on the vamp 104 and/or upward forces on the sole 102 will press the sole 102 and the vamp 104 together. In addition, the sole 102 and the vamp 104 may be cemented together, for example, by applying an adhesive to the heel ridge and/or lower heel sole aperture perimeter surface, and/or to the other surfaces of the sole 102 and vamp 104 which are in contact with each other. The adhesive may be used in other locations on the sole 102 or vamp 104, in particular in locations where the sole 102 and vamp 104 interface. In other embodiments, no adhesive is used to hold the sole 102 and the vamp 104 together, such that the sole 102 and the vamp 104 together provide the primary and/or only securing forces.

In other embodiments, the heel portion 144 of the sole 102 includes an upper heel rim 162. Portions of the upper heel rim 162 may extend into the foot opening 116 of the vamp 104. In other embodiments, portions of the upper heel rim 162 or the entire upper heel rim 162 remains below the foot opening 116 of the vamp 104.

Figure 7:
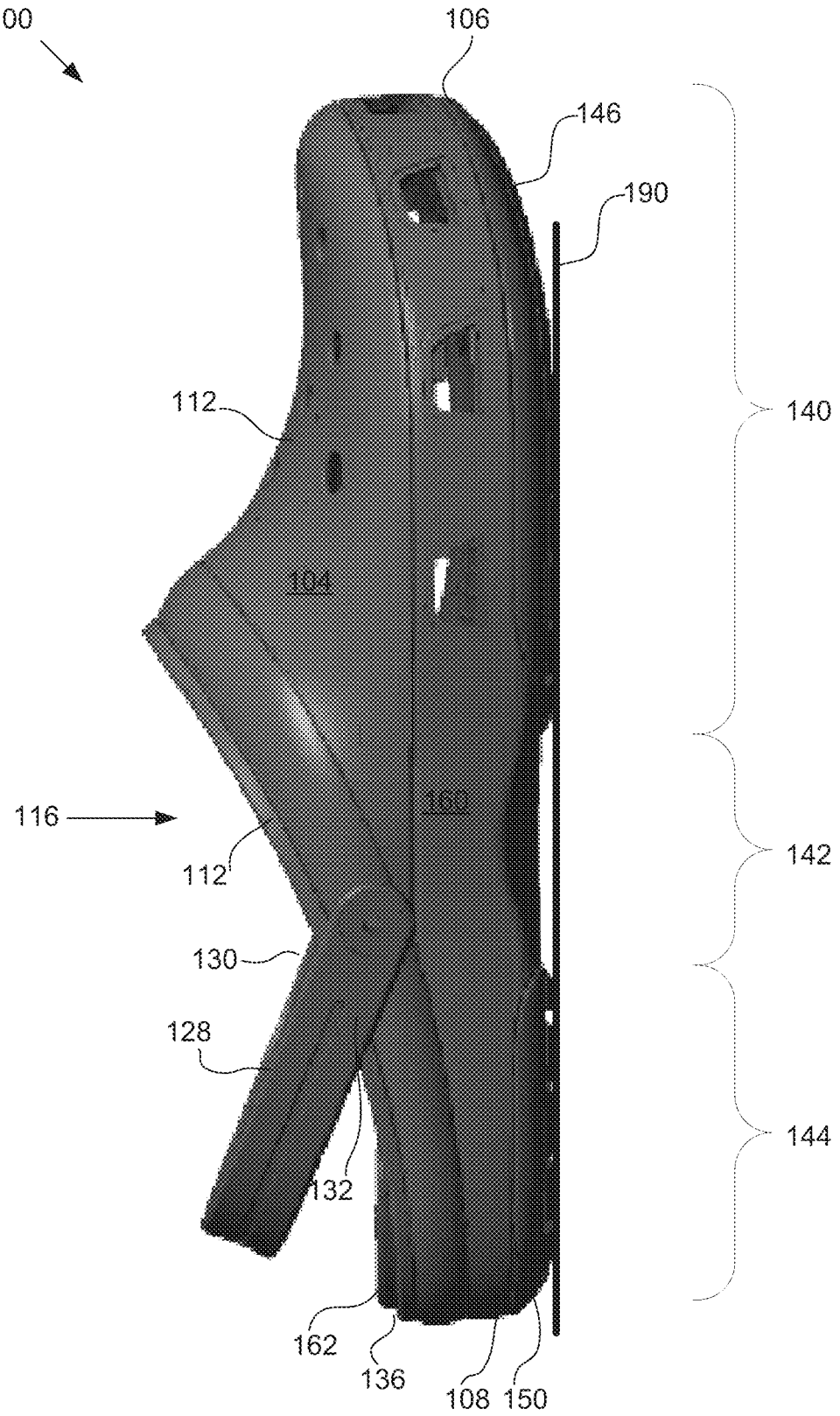
FIG. 7 illustrates a side view of the shoe assembly of FIG. 1.
Figure 8:
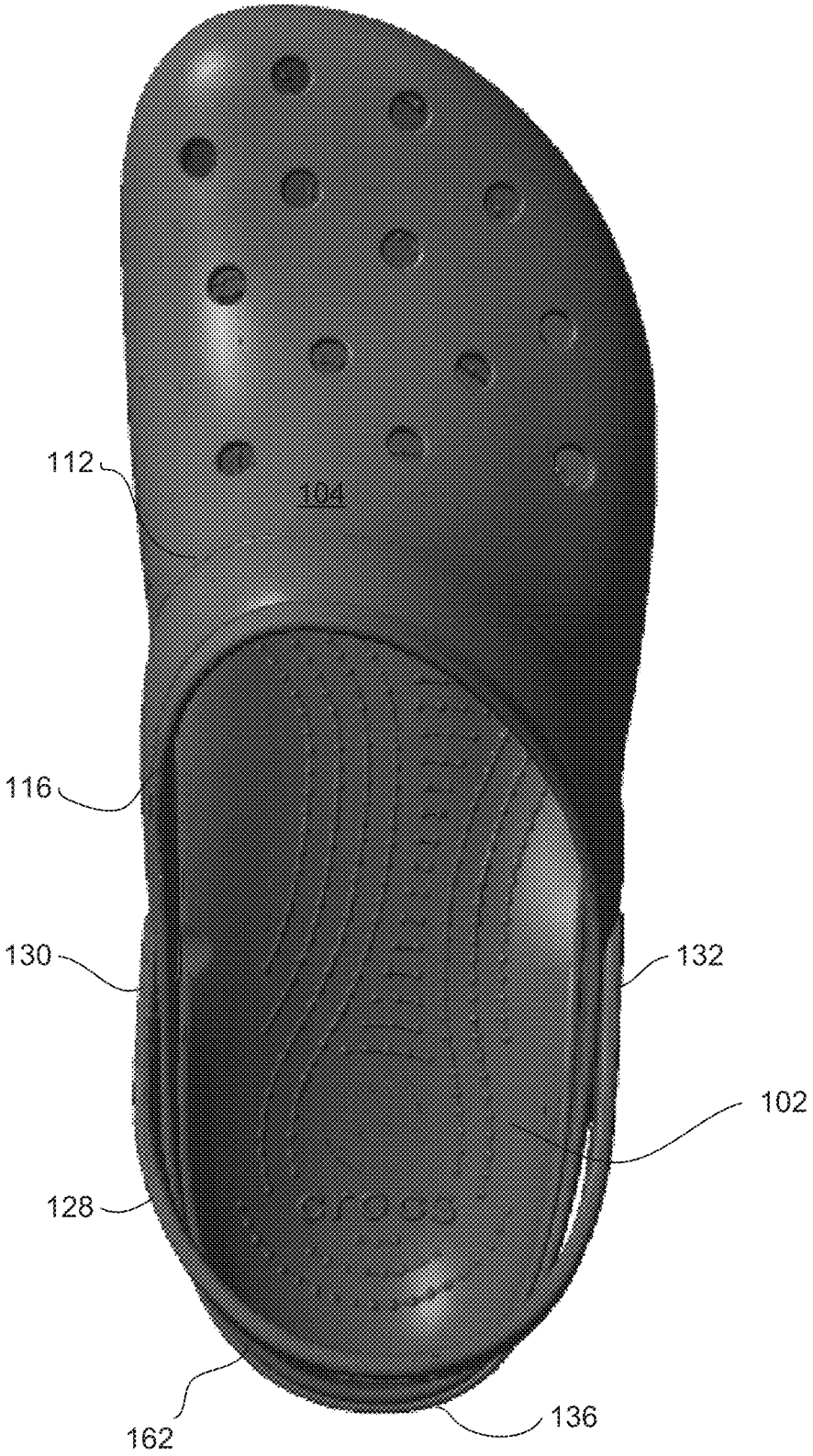
FIG. 8 illustrates a top view of the shoe assembly of FIG. 1.
Figure 9:
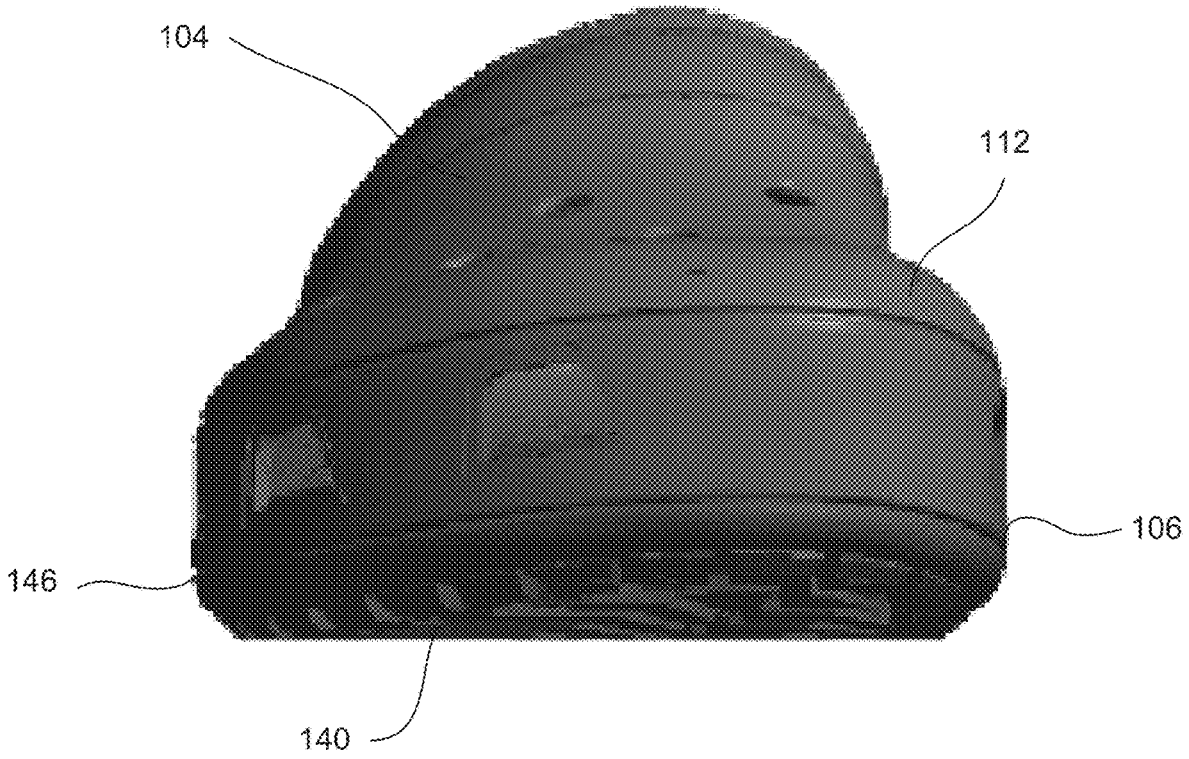
FIG. 9 illustrates a front view of the shoe assembly of FIG. 1.

When the shoe 100 is placed on a flat surface 190, as shown in FIG. 7, the forefoot section 140 of the sole 102 and the heel section 144 of the sole 102 may contact the flat surface 190 while the middle section 110 of the vamp 104 does not contact the flat surface 190. In fact, as shown in FIG. 7, in some embodiments none of the vamp 104 contacts the flat surface 190. In other embodiments, the middle section 110 of the vamp 104 contacts the flat surface 190 along with the forefoot portion 140 and the heel portion 144. In some embodiments, when a user steps into a shoe 100, the user's heel will be in direct contact with the heel portion 144 of the sole 102, which is in direct contact with the flat surface 190. Similarly, the user's forefoot will contact the forefoot portion 140 of the sole 102, which is in direct contact with the flat surface 190. This enables the user to benefit from the comfort, strength, and other properties of both the EVA-based material and the TPU material.

In some embodiments, the vamp 104 is comprised of a translucent TPU material. In those embodiments, the transparency and/or translucency of the TPU material permits the portions of the sole 102 that are covered by the vamp 104 to be visually perceived. At the same time, in some embodiments the TPU material is not perfectly transparent and may also incorporate a particular color. Nevertheless, in those embodiments the TPU material is transparent or translucent enough that the shape and/or color of the sole 102 may be identified through the TPU material. In some embodiments, the sole 102 is a different color from the vamp 104 to emphasize the transparency or translucency of the vamp 104. For example, the sole 102 may be a darker color than the TPU material of the vamp 104. A strap 128 attached to the vamp 104 may be the same color as the sole 102 but formed of the TPU material. In other embodiments, the strap 128 may be the same color as the vamp 104.

Figure 10:
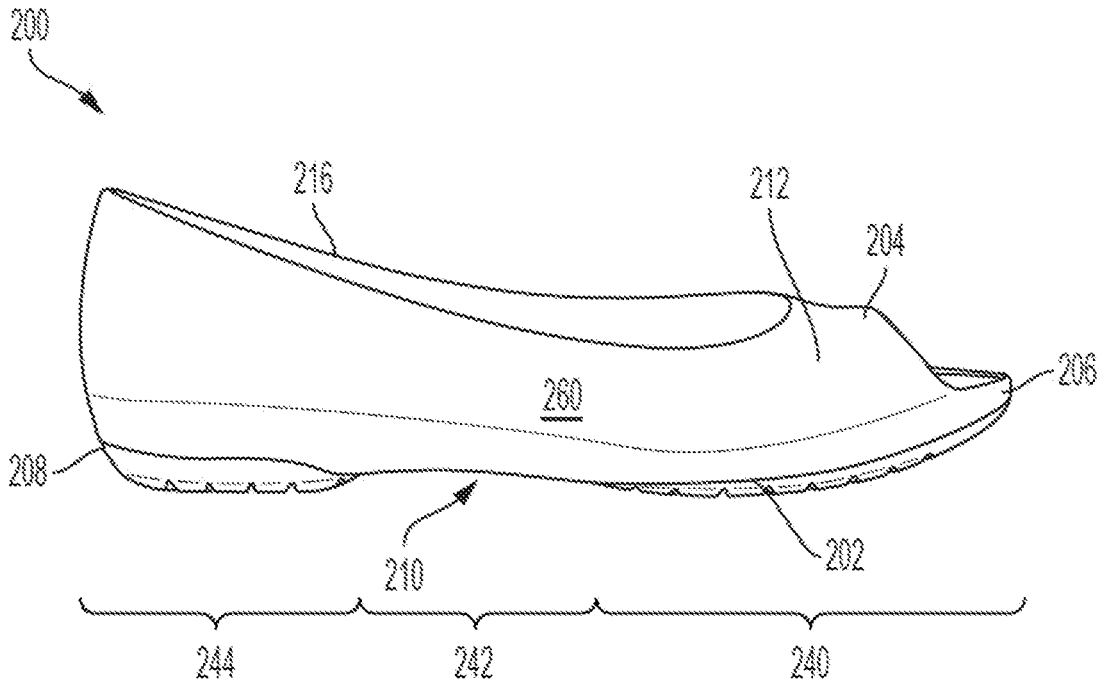
FIG. 10 illustrates a side view of a shoe assembly according to embodiments of the present invention.
Figure 11:
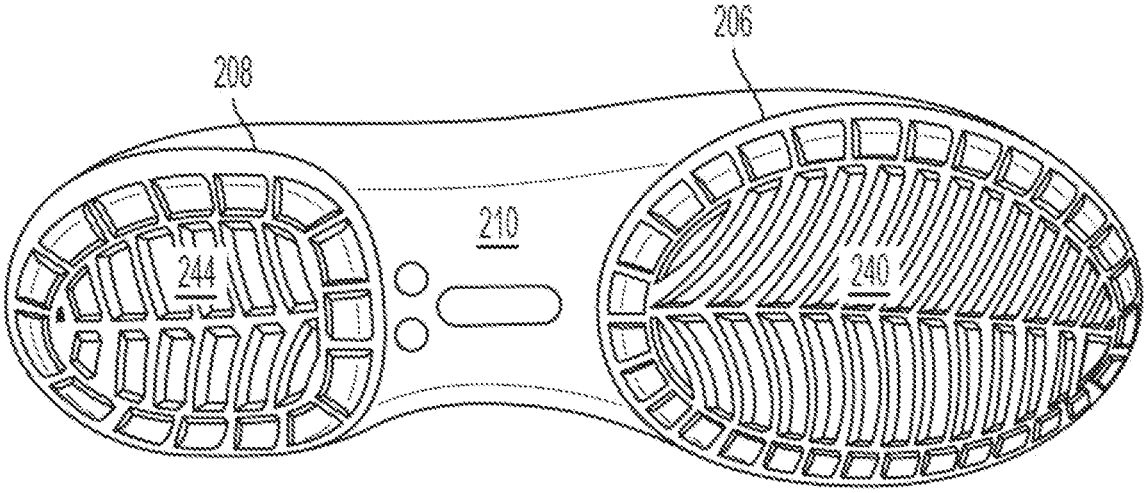
FIG. 11 illustrates a bottom view of the shoe assembly of FIG. 10.

FIGS. 10 and 11 illustrate a shoe 200 according to several embodiments. The vamp 204 of the shoe includes a foot opening 216. A band 260, which is formed by the middle section 210 of the vamp 204 and by the upper section 212 of the vamp 204, forms a continuous loop that encircles the midfoot portion 242 of the sole 202. The shoe 200 is constructed by inserting the forefoot portion 240 of the sole 202 into the forefoot sole aperture 206 of the vamp 204. The heel portion 244 of the sole 202 is snapped into the heel sole aperture 208 of the sole 202. An adhesive may be applied to portions of the sole 202 that interface with the vamp 204 to further secure the shoe 200.

Figure 14:
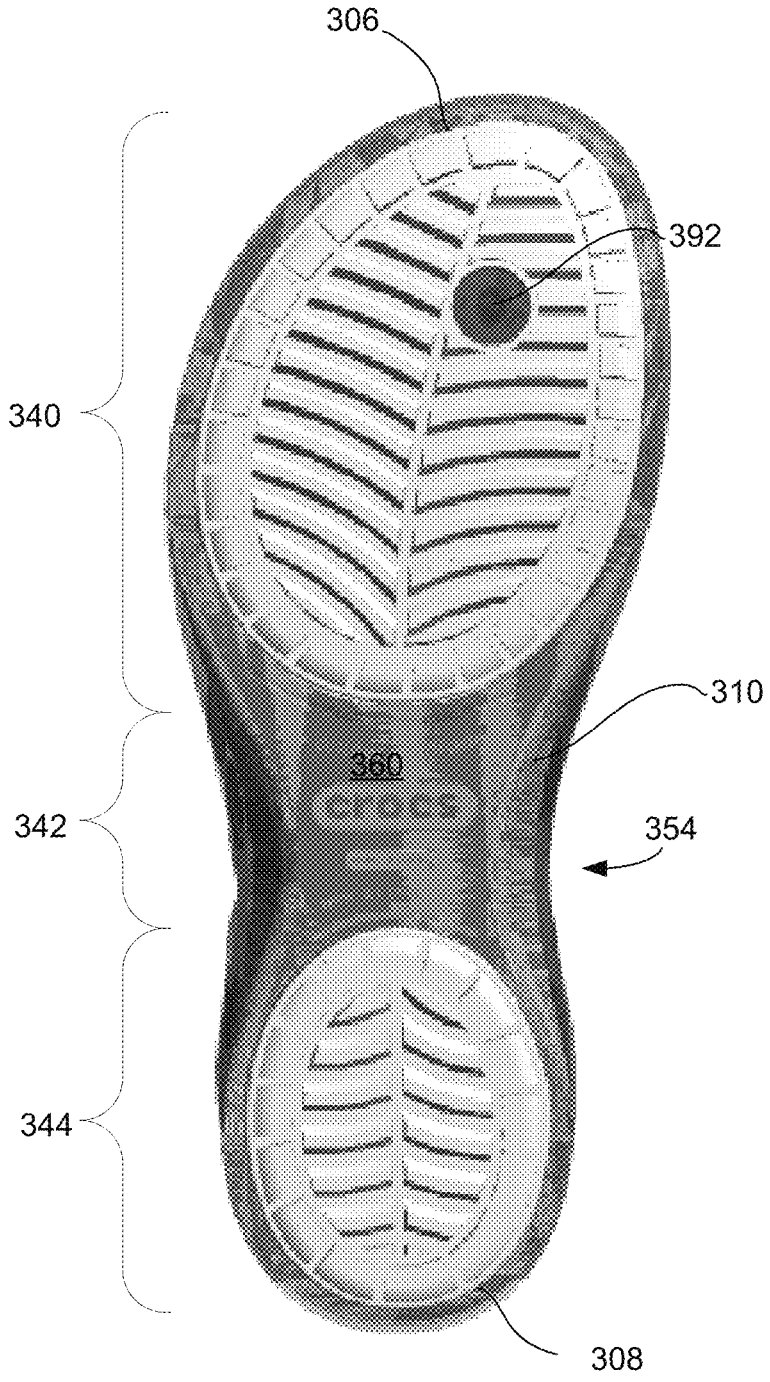
FIG. 14 illustrates a bottom view of the shoe assembly of FIG. 12.
Figure 15:
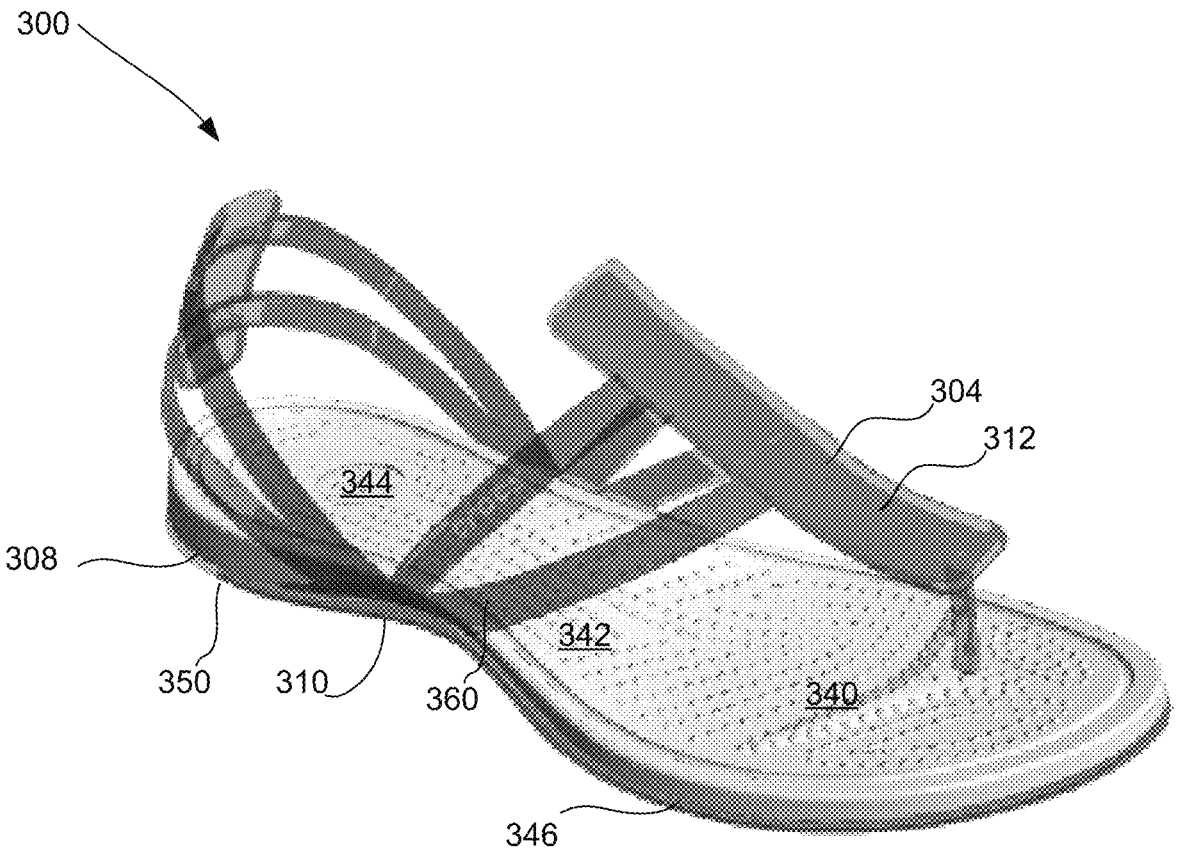
FIG. 15 illustrates a perspective view of the shoe assembly of FIG. 12.

In the embodiments shown in FIGS. 12-15, the vamp 304 of the shoe 300 may include multiple continuous bands 360. The continuous bands 360 may surround the foot opening 316. As shown in FIG. 14, the vamp 304 may include a forefoot insert 392 that is placed through the forefoot portion 340 of the sole 302. The forefoot insert 392 secures the vamp 304 to the inserted sole 302. In those embodiments, a cement may be used to secure components of the shoe 300.

Figure 12:
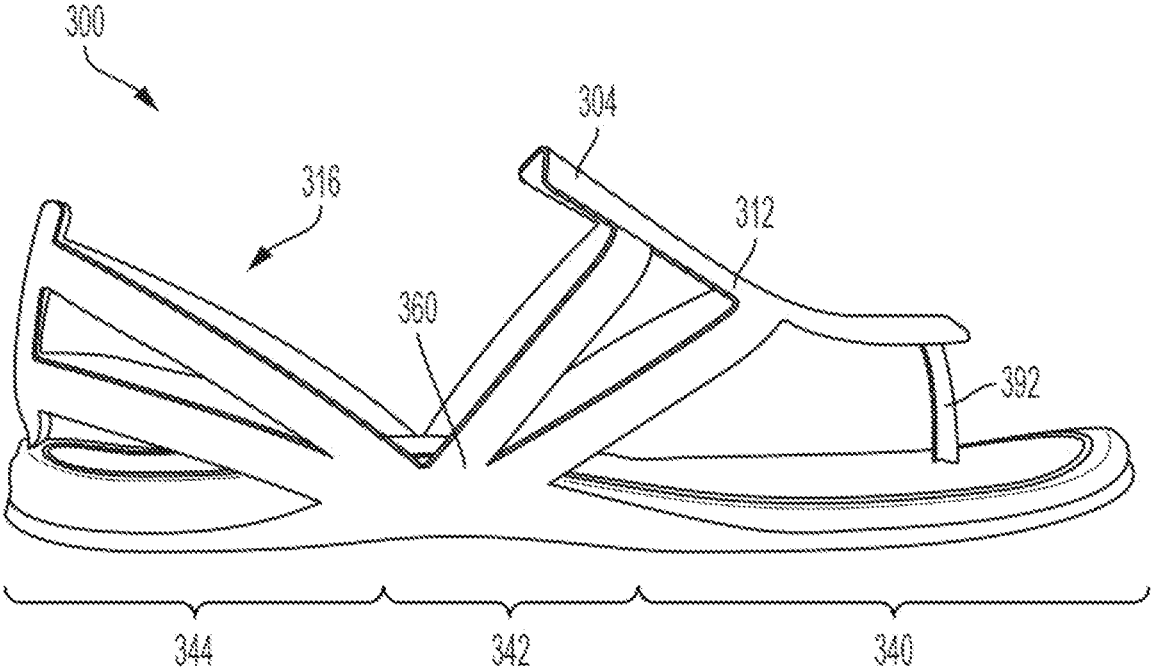
FIG. 12 illustrates a side view of a shoe assembly according to embodiments of the present invention.
Figure 13:
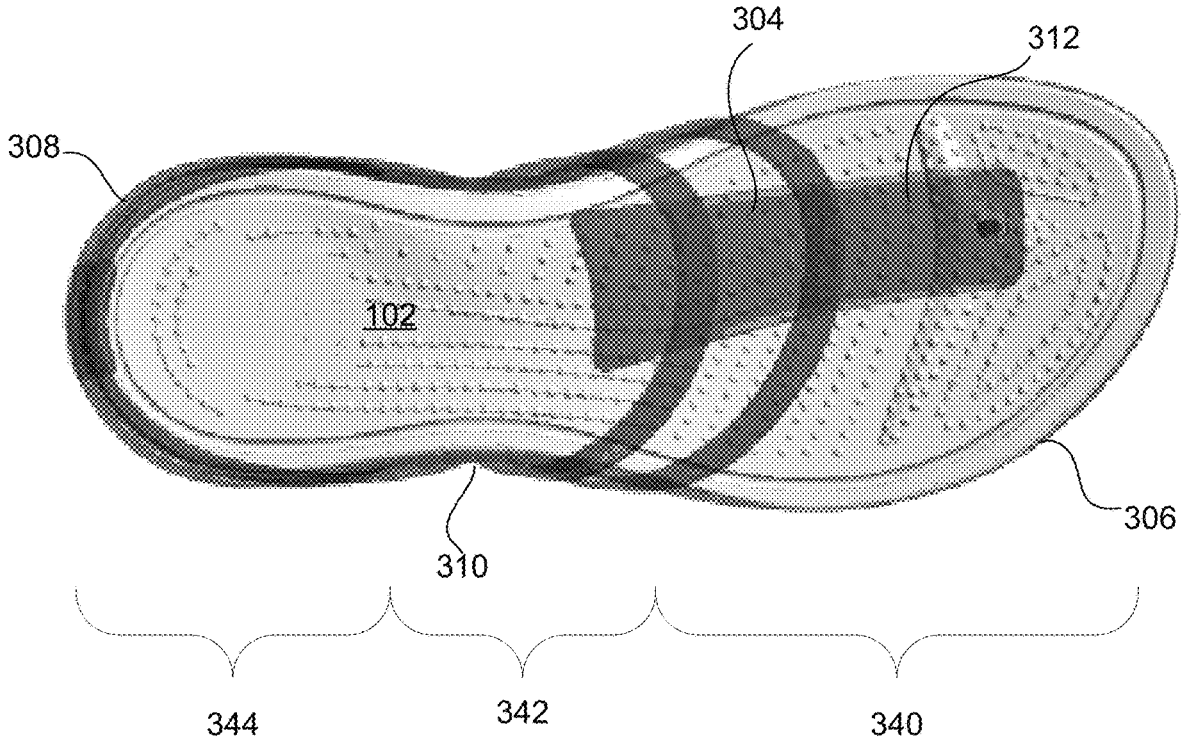
FIG. 13 illustrates a top view of the shoe assembly of FIG. 12.
Figure 16:
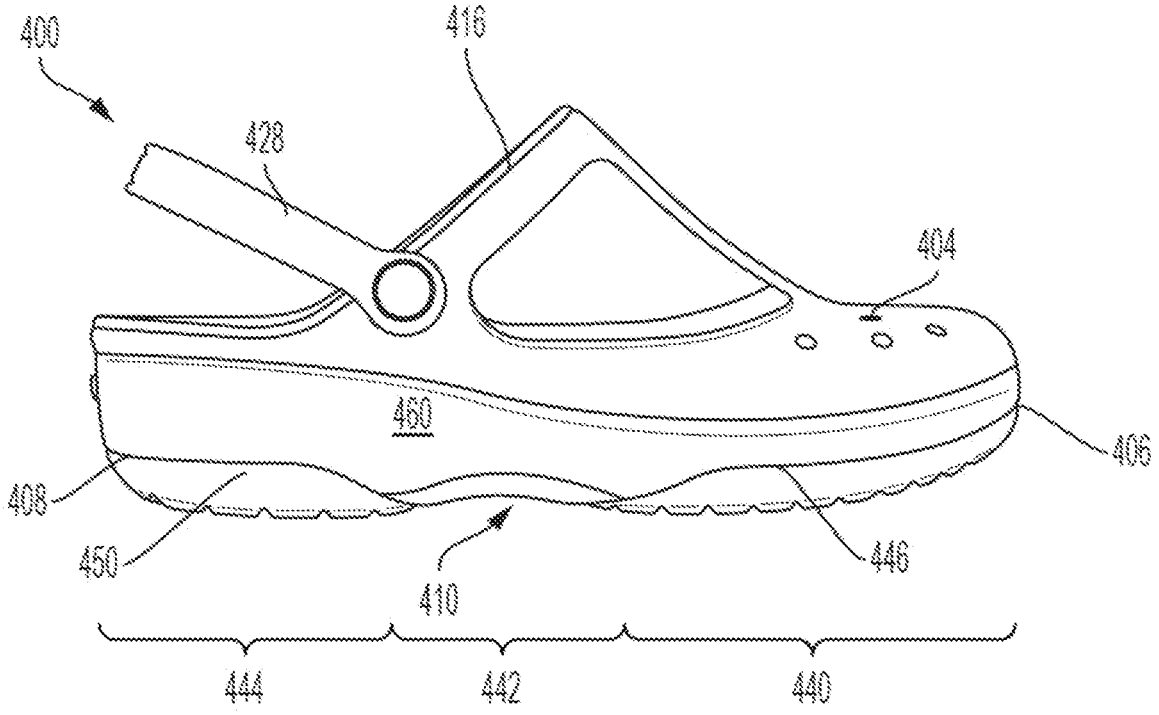
FIG. 16 illustrates a side view of a shoe assembly according to embodiments of the present invention.
Figure 17:
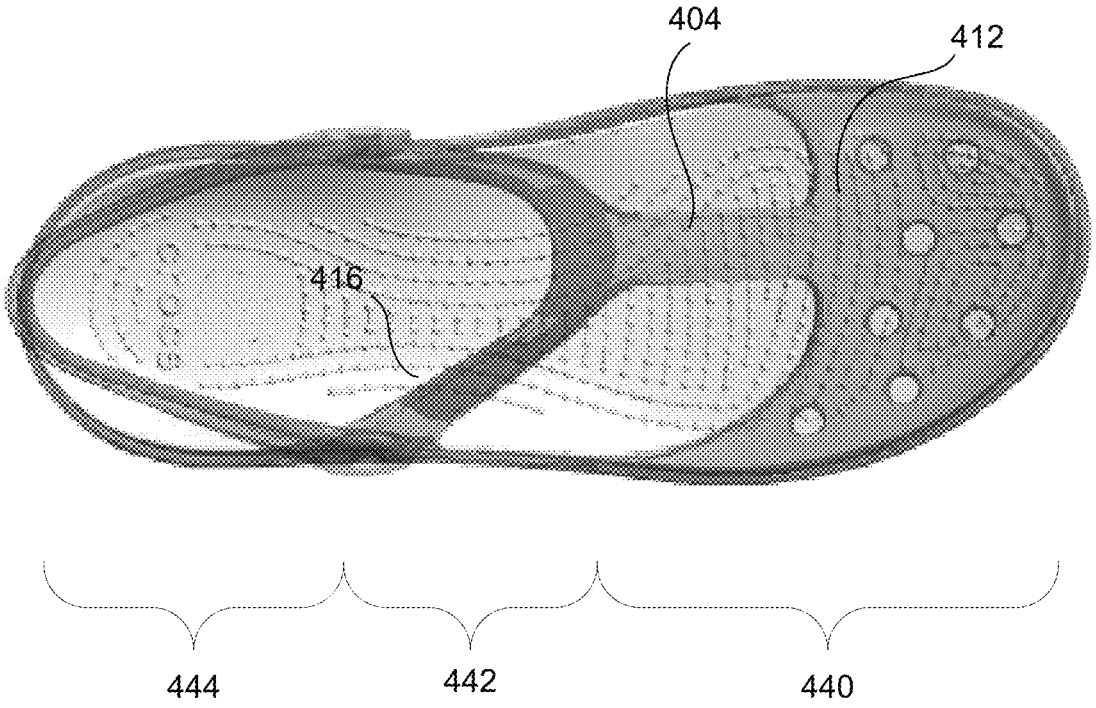
FIG. 17 illustrates a top view of the shoe assembly of FIG. 16.
Figure 18:
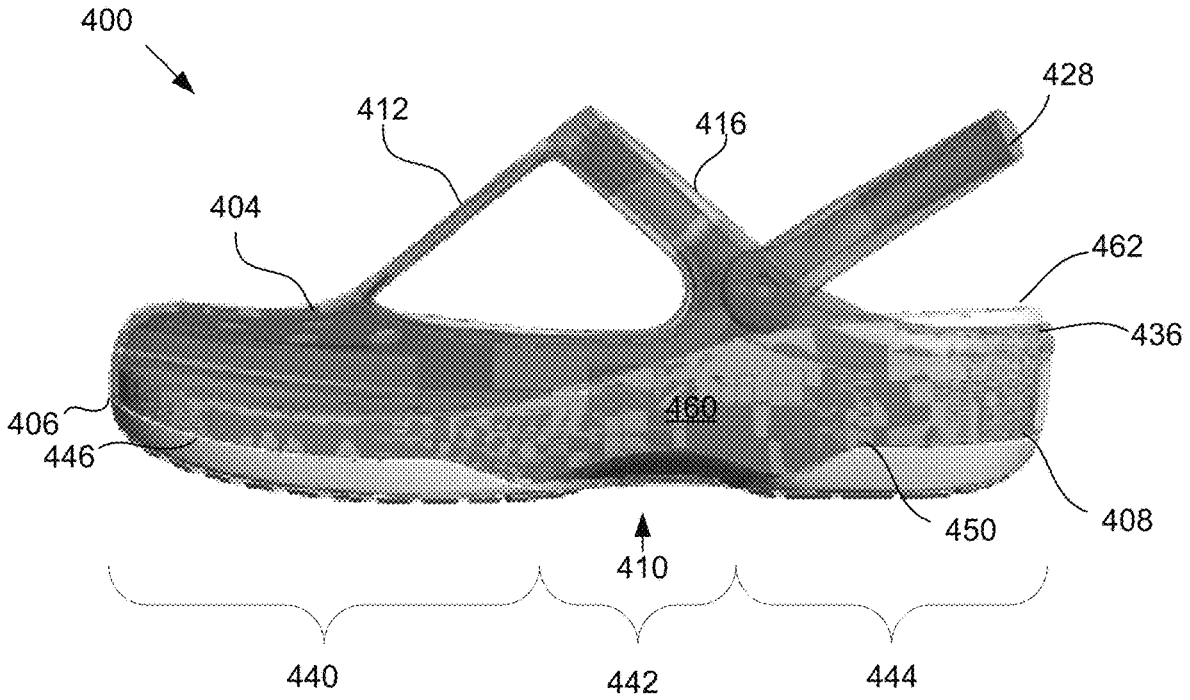
FIG. 18 illustrates an opposite side view of the shoe assembly of FIG. 16.
Figure 19:
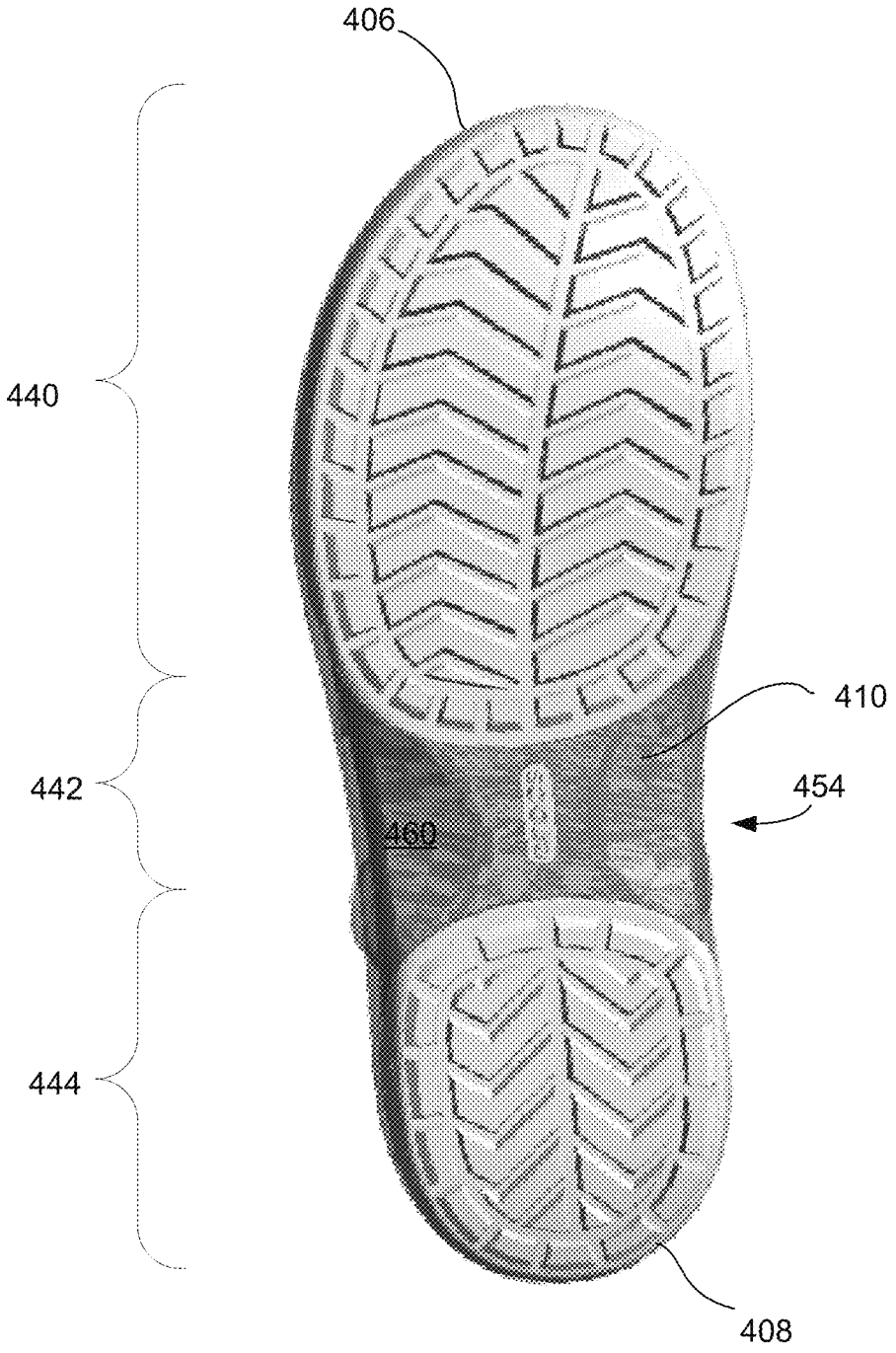
FIG. 19 illustrates a bottom view of the shoe assembly of FIG. 16.

As demonstrated by FIGS. 1-46, various vamp designs may be used according in various embodiments of the invention. For example, FIG. 1 illustrates a clog vamp, FIG. 10 illustrates a slipper vamp, FIG. 12 illustrates a sandal vamp, and FIG. 16 illustrates a shoe vamp.

In the embodiments shown in FIGS. 33 and 34, continuous bands 1260 lie within channels 1254 that run through different portions of the sole 1202. The bands may form a toe portion 1270 that lies below the front of the forefoot portion 1240. In those embodiments, the channels 1254 may be more narrow than the bands 1260 in order to increase the frictional retaining forces between the two when the bands 1260 are placed into their respective channels 1254. An adhesive may also be used to secure the bands 1260 within the channels 1254. The channels 1254 cover not only the bottom 1272 of the sole 1202, but also portions of the side 1274 of the sole 1020.

In the embodiments shown in FIGS. 35-45, a shoe 1300 comprises a sole 1302 and a vamp 1304. The vamp 1304 includes a bottom portion 1305 having a vamp forefoot portion 1306, a vamp midfoot portion 1308, and a vamp heel portion 1310. The vamp forefoot portion 1306 includes an outer forefoot portion 1312 and an inner forefoot portion 1314 separated by a vamp ridge 1316 and a forefoot ridge 1318. The vamp heel portion 1310 includes an outer heel portion 1320 and an inner heel portion 1322 separated by the vamp ridge 1316 and a heel ridge 1324. The vamp ridge 1316 may form a closed loop or may form one or more discontinuous ridges. In some embodiments the forefoot ridge 1318 and/or the heel ridge 1324 may connect with the outer vamp ridge 1316.

The inner forefoot portion 1314 includes a first forefoot aperture 1326, a second forefoot aperture 1328, and a third forefoot aperture 1330. Other embodiments may use more or less than three forefoot apertures. The first forefoot aperture 1326 and the second forefoot aperture 1328 are separated by a first forefoot band 1332 having a first forefoot band width 1333. The second forefoot aperture 1328 and the third forefoot aperture 1330 are separated by a second forefoot band 1334 having a second forefoot band width 1335. The first forefoot band width 1333 and the second forefoot band width 1335 may be equal or substantially the same. In some embodiments, the first and second forefoot bands 1332 and 1334 are parallel; in other embodiments the forefoot bands are placed at an angle to add asymmetric support. The forefoot bands 1332 and 1334 may be curved or otherwise constructed in a non-linear fashion to increase the length of the forefoot bands 1332 and 1334. The inner heel portion 1322 includes a heel aperture 1336. In some embodiments, the inner heel portion 1322 may include multiple heel apertures separated by heel bands.

The sole 1302 includes a sole forefoot portion 1340, a sole midfoot portion 1342, and a sole heel portion 1344. The sole forefoot portion 1340 includes several forefoot sections: a first forefoot section 1346, a second forefoot section 1348, and a third forefoot section 1350. The first forefoot section 1346 and the second forefoot section 1348 are at least partially separated by a first forefoot channel 1352 having a first forefoot channel width 1353. The first forefoot channel width 1353 may be equal to or slightly smaller than the first forefoot band width 1333. The second forefoot section 1348 and the third forefoot section 1350 are at least partially separated by a second forefoot channel 1354 having a second forefoot channel width 1355. The second forefoot channel width 1355 may be equal to or slightly smaller than the second forefoot band width 1335. The first forefoot channel width 1353 and the second forefoot channel width 1355 may be equal or substantially the same. The first forefoot channel 1352 and the second forefoot channel 1354 may be formed to match the shape of the forefoot bands 1332 and 1334, respectively.

Figure 37A:
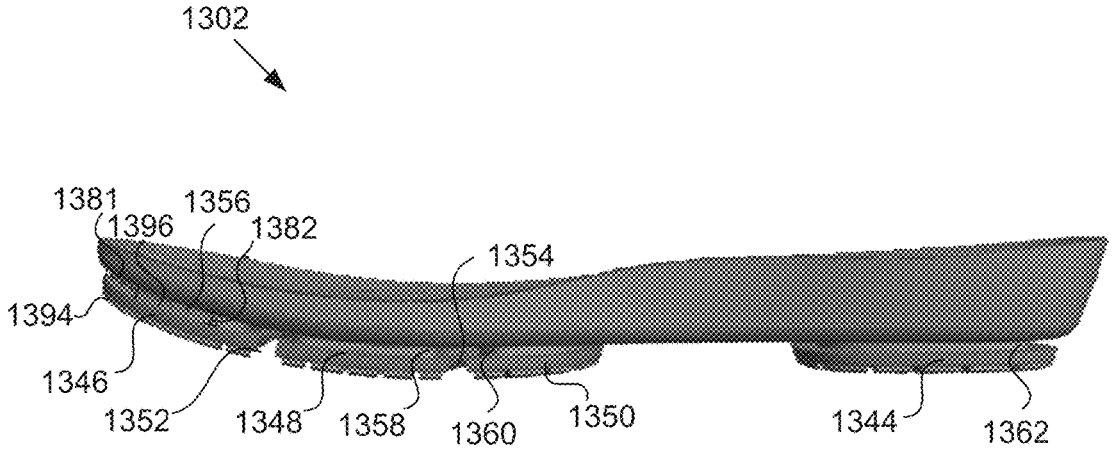
FIG. 37A illustrates an inside perspective view of the sole of the shoe assembly of FIG. 35.
Figure 37B:
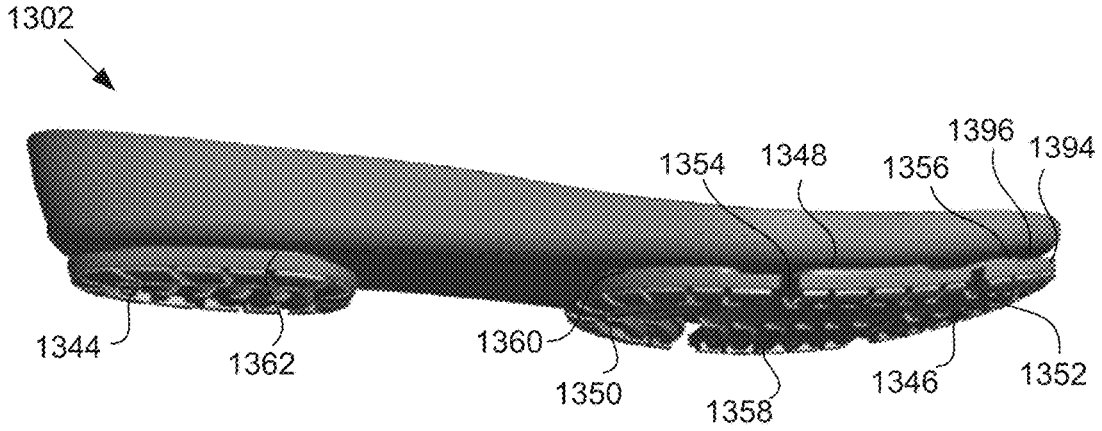
FIG. 37B illustrates an outside perspective view of the sole of the shoe assembly of FIG. 35.
Figure 38:
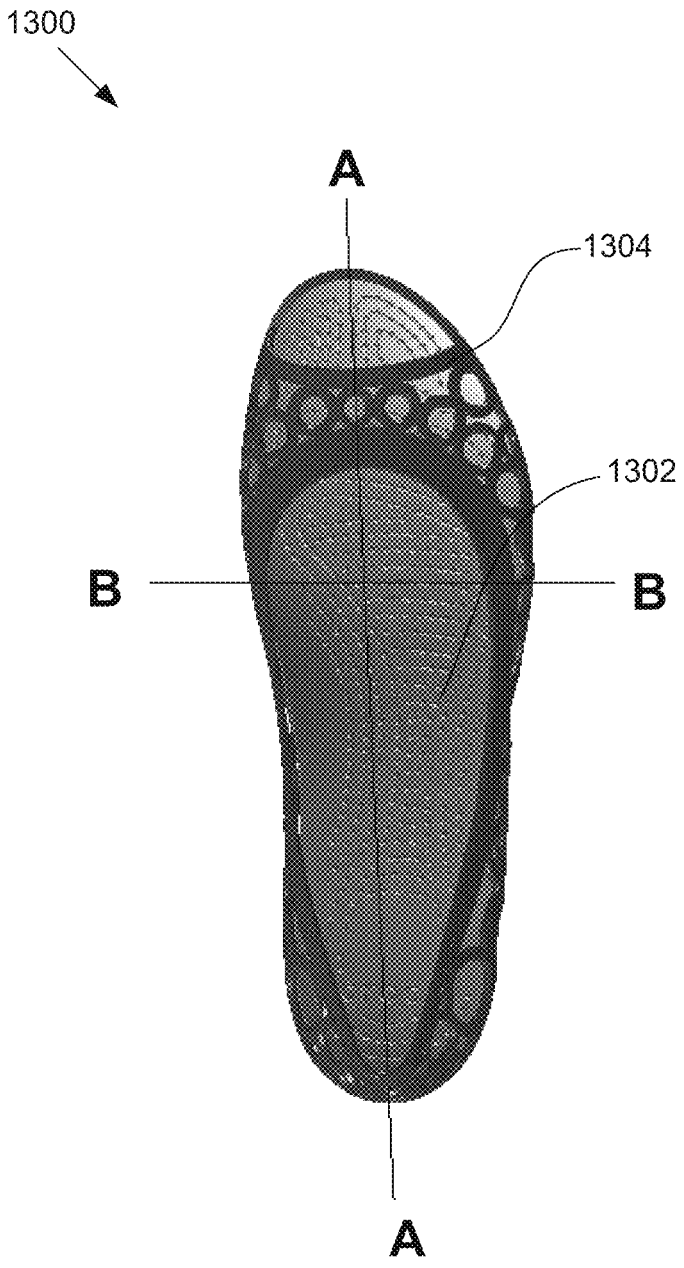
FIG. 38 illustrates a top view of the shoe assembly of FIG. 35.

As best shown in FIGS. 37A and 37B, the first forefoot section 1346 includes a first groove 1356, the second forefoot section 1348 includes a second groove 1358, and the third forefoot section 1350 include a third groove 1360. The grooves 1356, 1358, and 1360 at least partially circumscribe their respective forefoot sections or portions thereof in continuous loops. In other embodiments, the grooves 1356, 1358, and 1360 do not each form continuous loops but may instead form one or more discrete groove sections. The sole heel portion 1344 likewise includes a heel groove 1362 that at least partially circumscribes the heel portion 1344 in a continuous loop or in one or more discrete groove sections.

The sole 1302 and the vamp 1304 are constructed so that the sole and the vamp may be secured together (e.g., in a snap-fit configuration) without the need for adhesive or any additional binding mechanisms. As discussed above, the width 1353 of the first forefoot channel 1352 of the sole 1302 is sized to be equal to or slightly smaller than the width 1333 of the first forefoot band 1332 of the vamp 1304. Likewise, the width 1355 of the second forefoot channel 1354 of the sole 1302 is sized to be equal to or slightly smaller than the width 1335 of the second forefoot band 1334 of the vamp 1304. In addition, an outer perimeter 1370 of the first forefoot section 1346 of the sole 1302 is larger than a perimeter 1372 of the first forefoot aperture 1326 of the vamp 1304; an outer perimeter 1374 of the second forefoot section 1348 of the sole 1302 is larger than a perimeter 1376 of the second forefoot aperture 1328 of the vamp 1304; and an outer perimeter 1377 of the third forefoot section 1350 of the sole 1302 is larger than a perimeter 1378 of the third forefoot aperture 1330 of the vamp 1304. An outer perimeter 1379 of the heel portion 1344 is likewise larger than the perimeter 1380 of the heel aperture 1336 of the vamp 1304.

The first groove 1356 is dimensioned to receive at least some of the inner forefoot portion 1314 of the vamp 1304, including portions of the first forefoot band 1332. When the sole 1302 is inserted into the vamp 1304, the perimeter 1372 of the first forefoot aperture 1326 may be adjacent to, and make contact with, the first forefoot section 1346 within the first groove 1356. In some embodiments, the entire perimeter 1372 of the first forefoot aperture 1326 contacts the first forefoot section 1346 within the first groove 1356. The first groove 1356 may have a depth 1381 of 7 mm. In other embodiments, the depth 1381 of the first groove 1356 may be from 1 mm deep to 10 mm deep. In some embodiments, the first groove at least partially circumscribes the first forefoot section 1346. In some embodiments, the depth 1381 of the first groove 1356 may be less than 1 mm or greater than 10 mm. In some embodiments, the depth of the first groove 1356 is not uniform and may be larger or smaller in certain sections. For example, the portion of the first groove 1356 that receives the first band 1332 of the vamp 1304 may be less deep than the rest of the first groove 1356.

The depth of the second groove 1358, the third groove 1360, and the heel grove 1362 may be similarly structured so that the outer perimeters (1376, 1378, and 1380) of the corresponding apertures (1328, 1330, and 1336) may likewise contact (in whole or in part) the corresponding sole sections within the corresponding grooves.

Figure 39A:
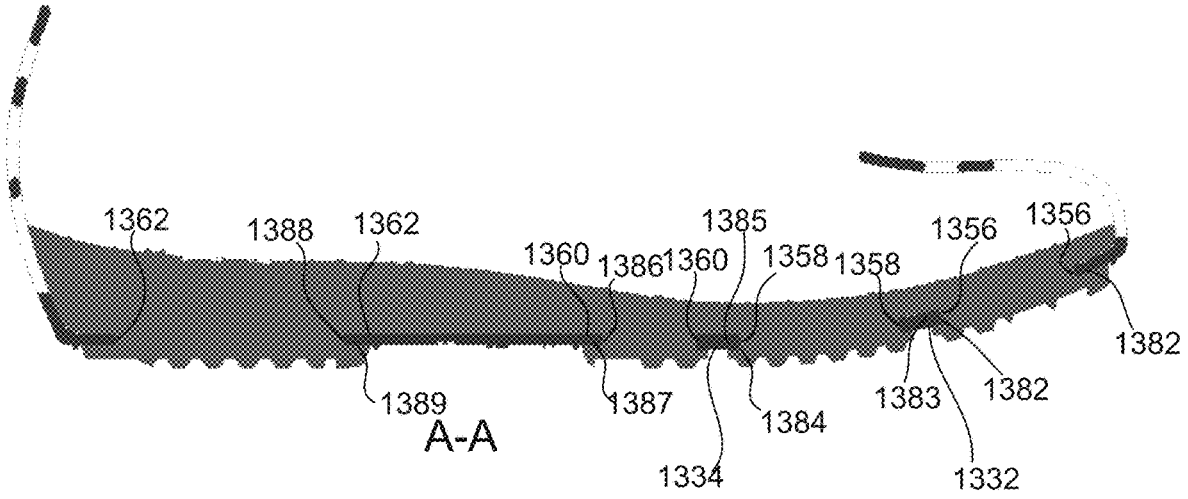
FIG. 39A illustrates the shoe assembly of FIG. 35 cut along the line A-A in FIG. 38.
Figure 39B:
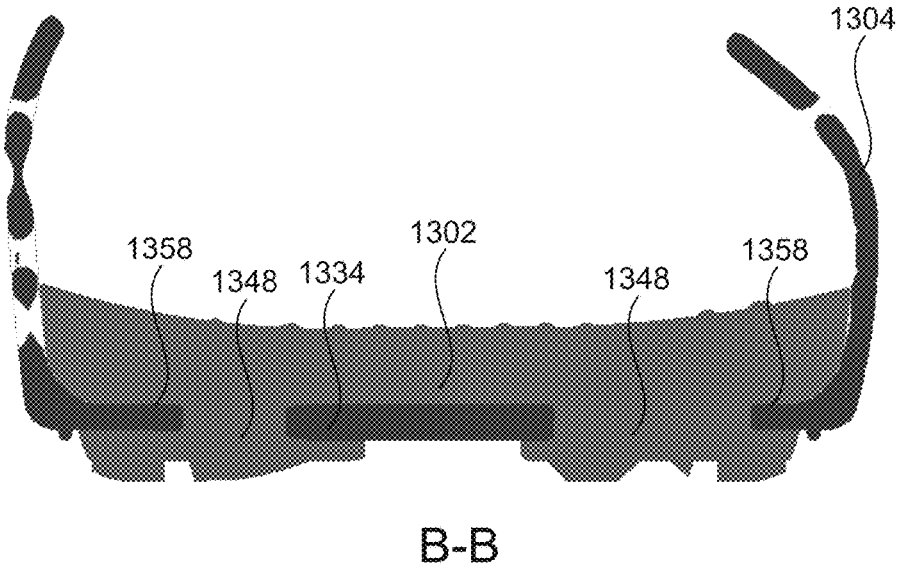
FIG. 39B illustrates the shoe assembly of FIG. 35 cut along the line B-B in FIG. 38.
Figure 40:
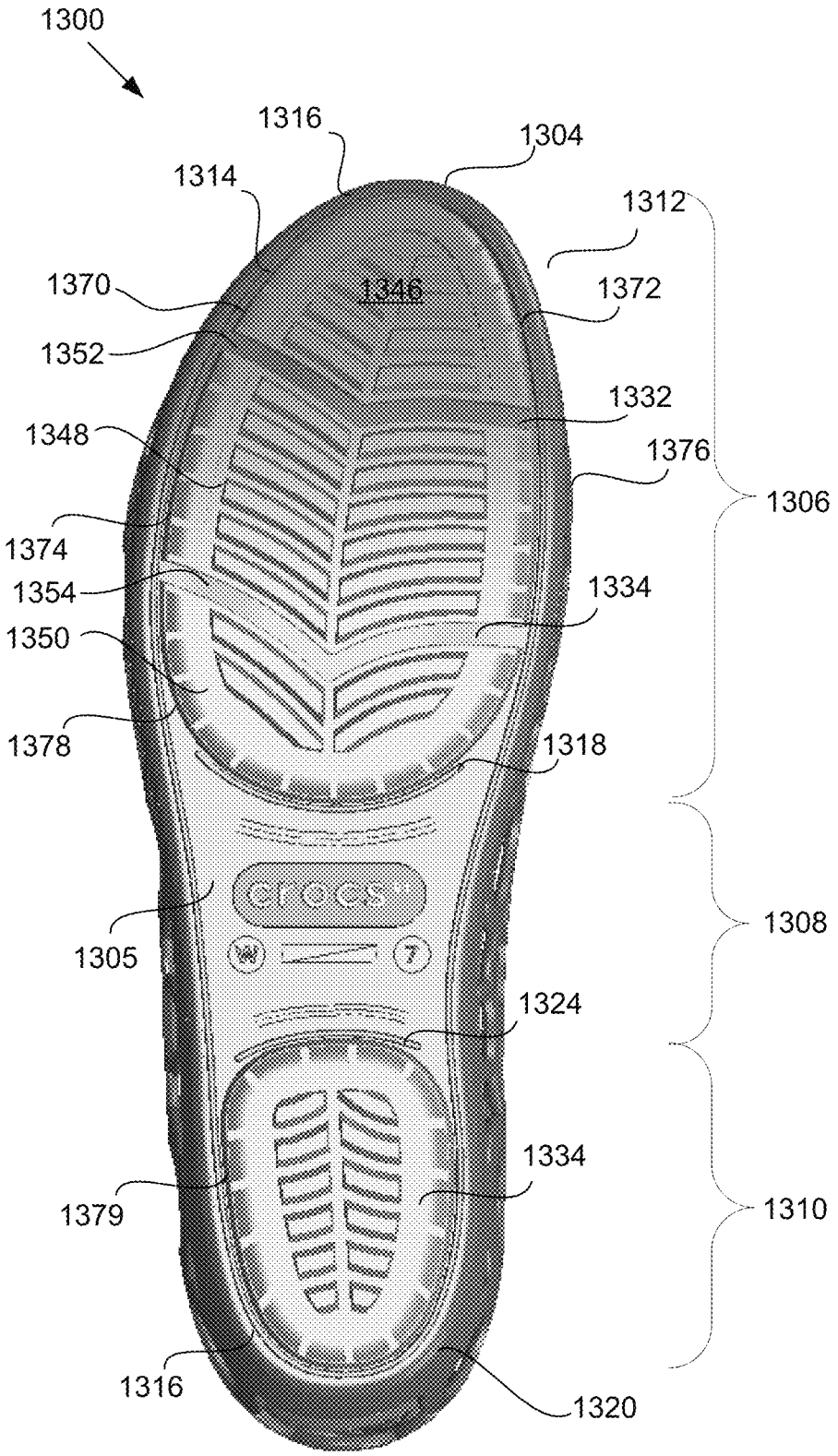
FIG. 40 illustrates a bottom view of the shoe assembly of FIG. 35.
Figure 41:
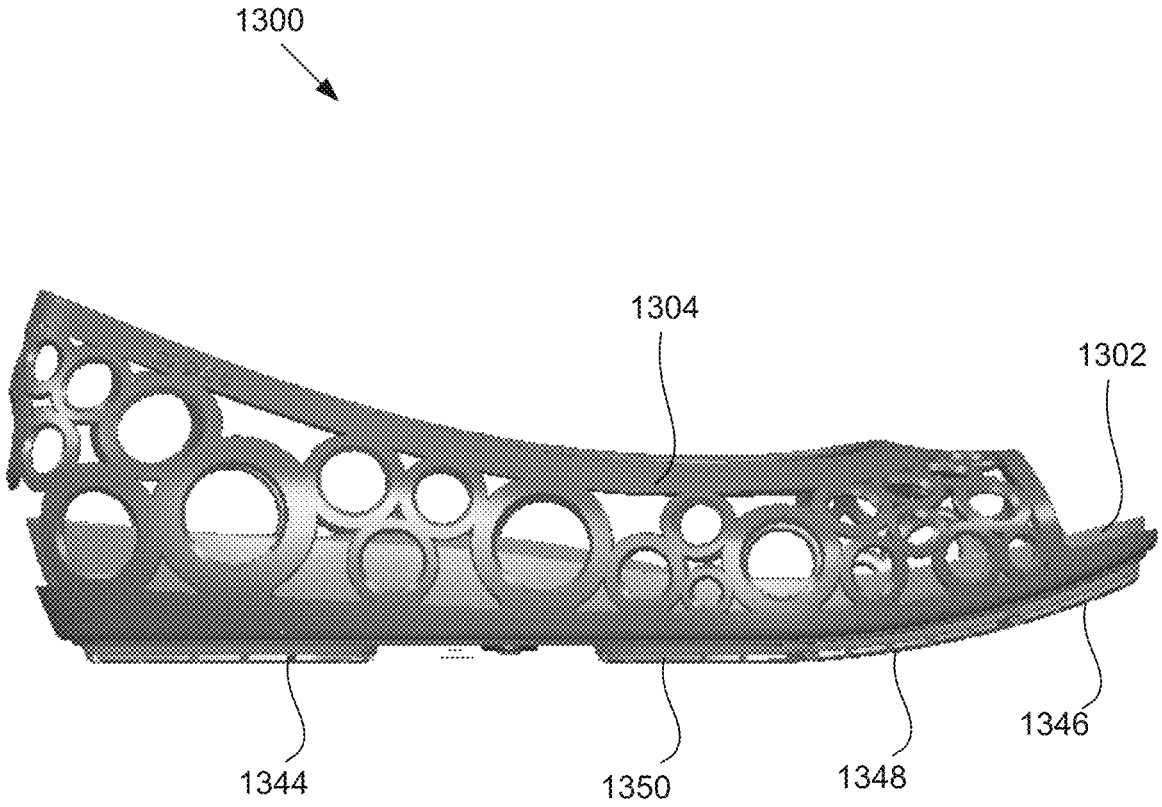
FIG. 41 illustrates an outside side elevation view of the shoe assembly of FIG. 35.
Figure 42:
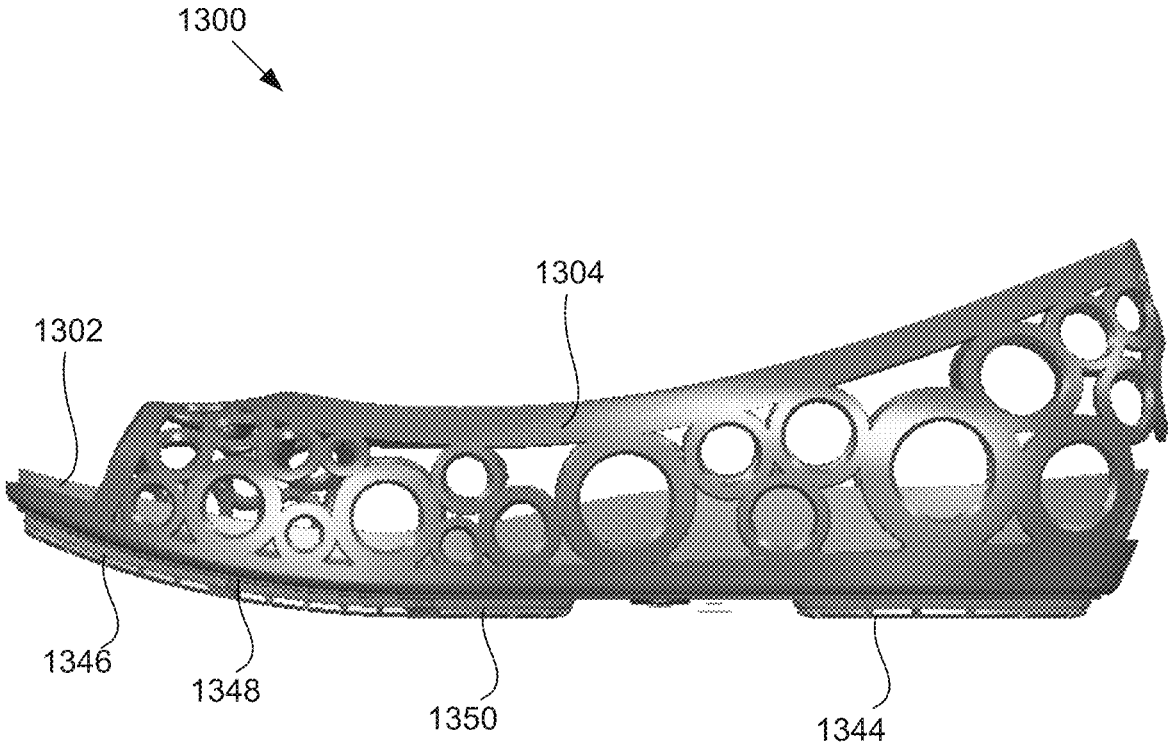
FIG. 42 illustrates an inside side elevation view of the shoe assembly of FIG. 35.
Figure 43:
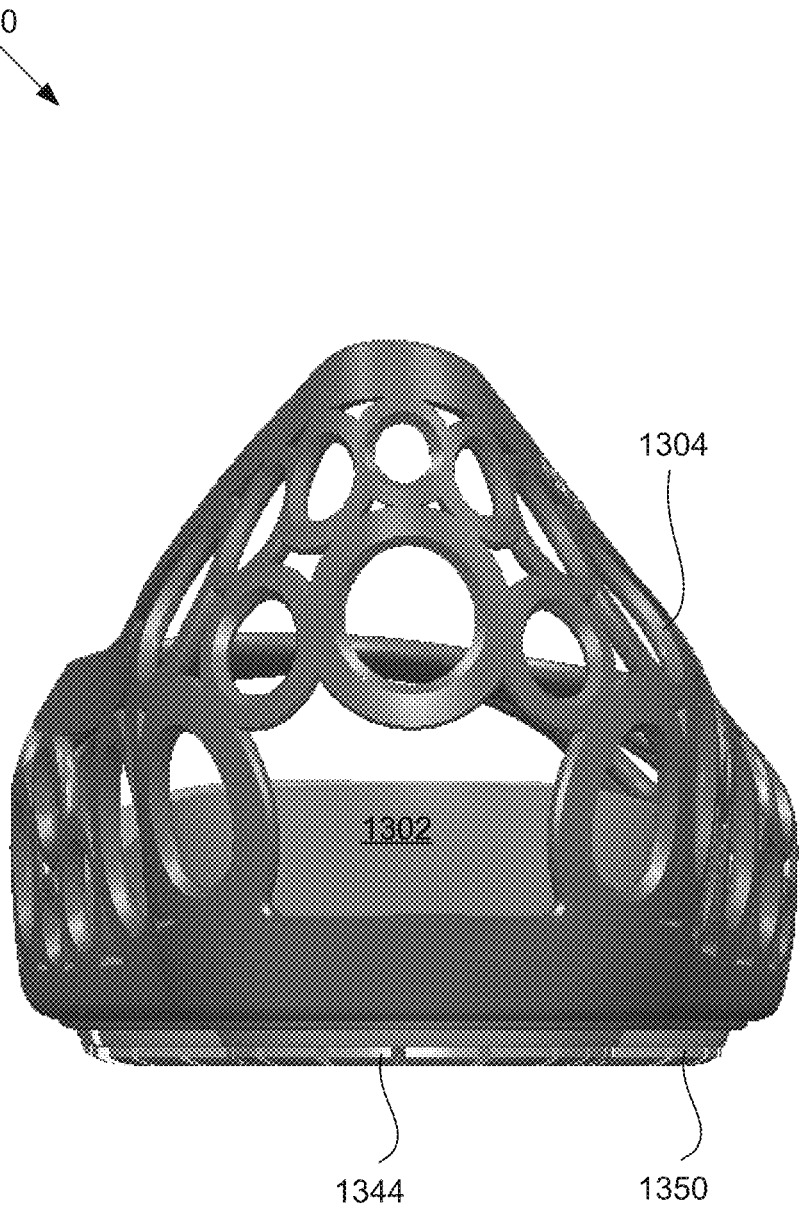
FIG. 43 illustrates a back elevation view of the shoe assembly of FIG. 35.
Figure 44:
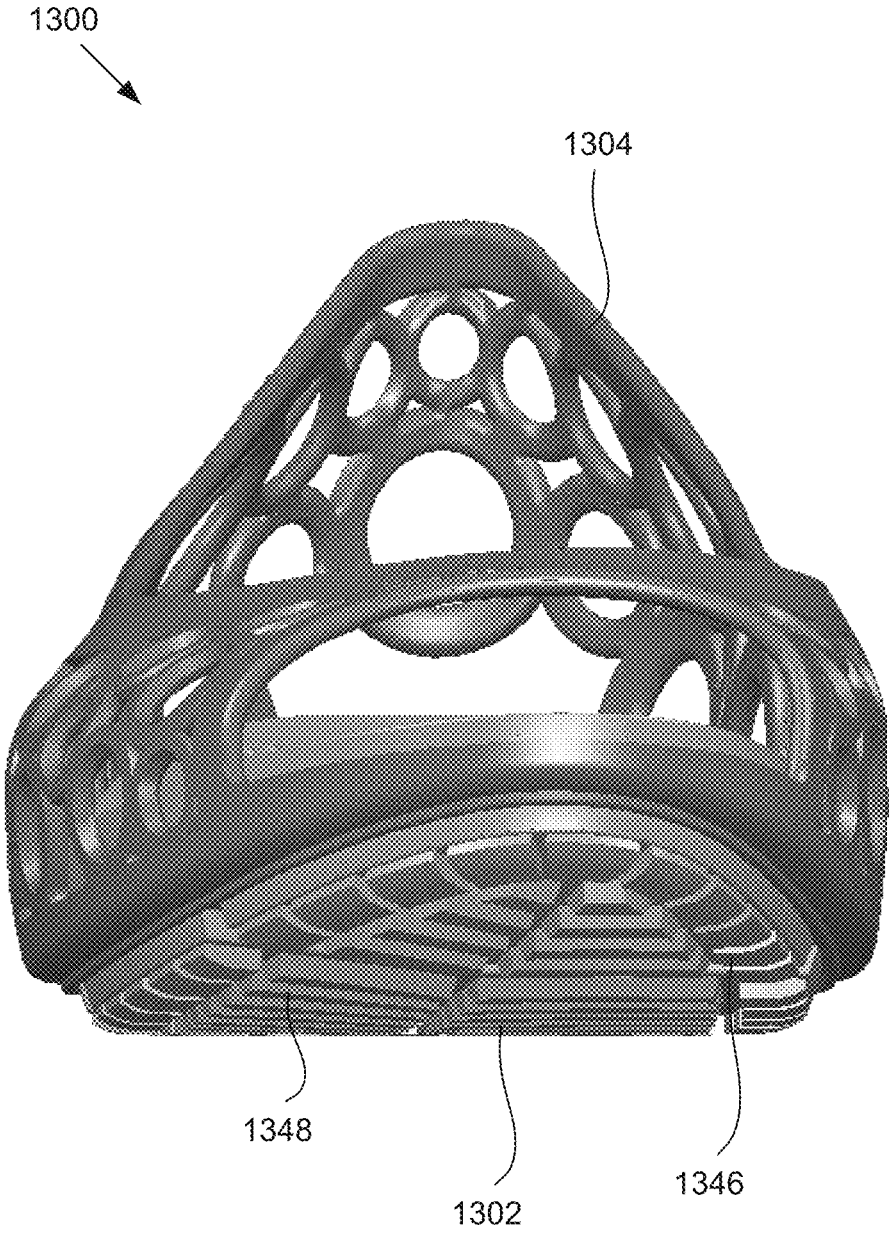
FIG. 44 illustrates a front elevation view of the shoe assembly of FIG. 35.
Figure 45:
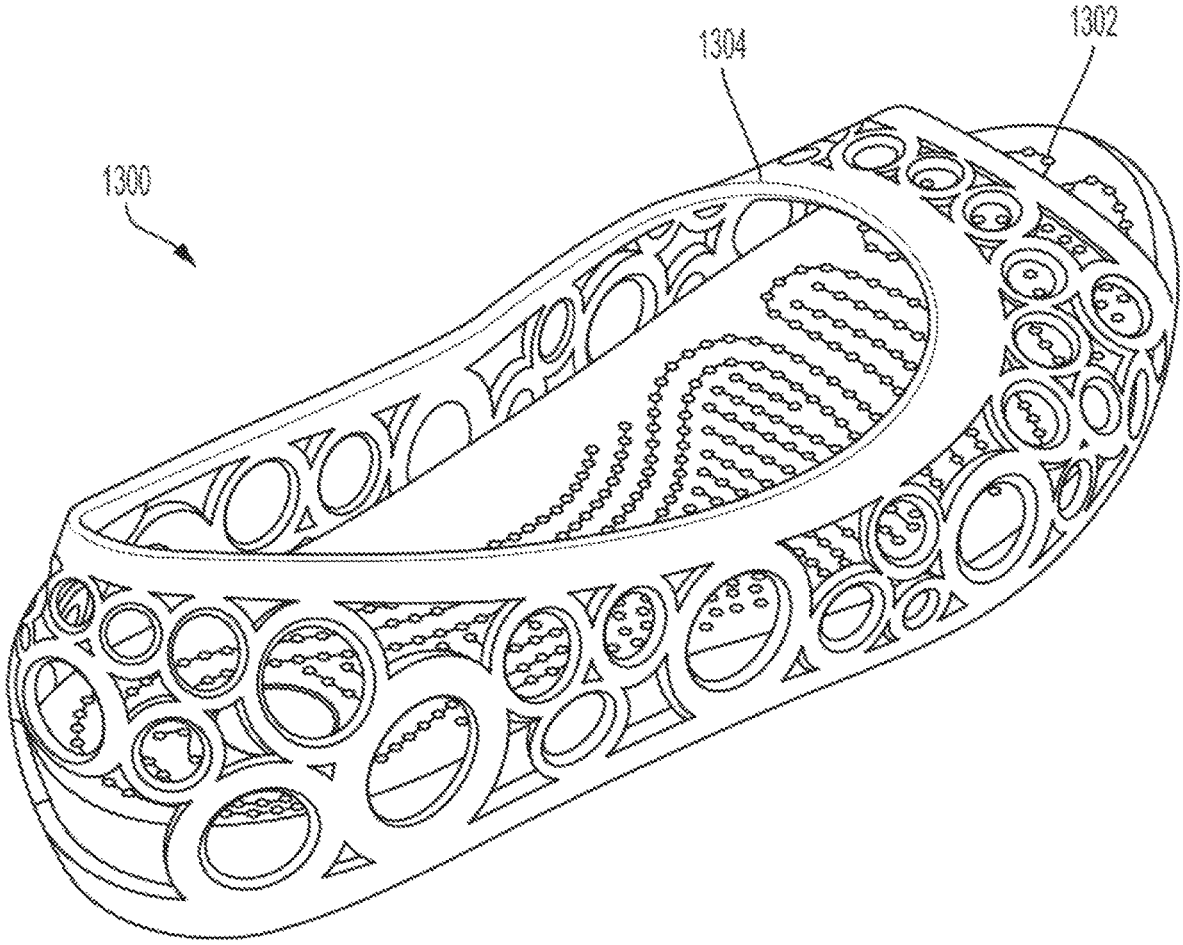
FIG. 45 illustrates a top perspective view of the shoe assembly of FIG. 35.

As best shown in FIG. 39A, the height 1382 of the first groove 1356 may be equal to, slightly smaller than, or slightly larger than the thickness (e.g., 1383) of the portions of the inner forefoot portion 1314 of the vamp 1304 that are received by the first groove 1356. Thickness 1383 is shown as an example. In some embodiments, the thickness of the vamp 1304 or of the inner forefoot portion 1314 of the vamp 1304 may not be uniform. For example, the thickness of the inner forefoot portion 1314 of the vamp 1304 may be greater or lesser in some locations (e.g., the first band 1332). In those embodiments, the height 1382 of the first groove 1356 will likewise be larger and/or smaller in corresponding locations to match the thickness of the portions of the inner forefoot portion 1314 of the vamp 1304 that are received within the first groove 1356.

The second groove 1358 is dimensioned to receive at least some of the inner forefoot portion 1314, including the first forefoot band 1332 and the second forefoot band 1334. The height 1384 of the second groove 1356 may be equal to, slightly smaller than, or slightly larger than the thickness (e.g., 1385) of the portions of the inner forefoot portion 1314 of the vamp 1304 that are received by the second groove 1358. Thickness 1385 is shown as an example. In some embodiments, the thickness of the vamp 1304 or of the inner forefoot portion 1314 of the vamp 1304 may not be uniform. For example, the thickness of the inner forefoot portion 1314 of the vamp 1304 may be greater or lesser in some locations (e.g., the first band 1332). In those embodiments, the height 1384 of the second groove 1358 will likewise be larger and/or smaller in corresponding locations to match the thickness of the portions of the inner forefoot portion 1314 of the vamp 1304 that are received within the second groove 1358.

The third groove 1360 is dimensioned to receive at least some of the inner forefoot portion 1314, including the second forefoot band 1334. The height 1386 of the third groove 1360 may be equal to, slightly smaller than, or slightly larger than the thickness (e.g., 1387) of the portions of the inner forefoot portions 1314 of the vamp 1304 that are received by the third groove 1360. Thickness 1387 is shown as an example. In some embodiments, the thickness of the vamp 1304 or of the inner forefoot portion 1314 of the vamp 1304 may not be uniform. For example, the thickness the inner forefoot section 1314 of the vamp 1304 may be greater or lesser in some locations (e.g., the first band 1332). In those embodiments, the height 1386 of the third groove 1360 will likewise be larger and/or smaller in corresponding locations to match the thickness of the portions of the inner forefoot portion 1314 of the vamp 1304 that are received within the third groove 1360.

The heel groove 1362 is dimensioned to receive at least some of the inner heel portion 1322. The height 1388 of the heel groove 1362 may be equal to or slightly larger than the thickness (e.g., 1389) of the portions of the inner heel portion 1322 of the vamp 1304 that are received by the heel groove 1362. Thickness 1389 is shown as an example. In some embodiments, the thickness of the vamp 1304 or of the inner heel portion 1322 of the vamp 1304 may not be uniform. For example, as the thickness of the inner heel section 1322 of the vamp 1304 may be greater or lesser in some locations. In those embodiments, the height 1388 of the heel groove 1362 will likewise be larger and/or smaller in corresponding locations to match the thickness of the portions of the inner heel portion 1322 of the vamp 1304 that are received in the heel groove 1362.

In some embodiments, the vamp 1304 is formed of an elastic material that can expand in response to expansive forces and return to its original shape after the expansive forces are removed. In other embodiments, the sole 1302 is formed of an elastic material that compresses in response to compressive forces and returns to its original shape after the compressive forces are removed. In yet other embodiments, both the vamp 1304 and the sole 1302 are each formed of elastic materials. For example, the vamp 1304 may be formed of a single continuous piece of thermoplastic polyurethane (TPU) or other similar materials, and the sole 1302 may be formed of an EVA-based material. Thus, the elastic materials may contribute biasing forces that help secure the vamp to the sole.

To insert the sole 1302 into the vamp 1304, the first forefoot section 1346 of the sole 1302 (specifically the outer perimeter 1370) is pushed through the first forefoot aperture 1326 of the vamp 1304. Because the outer perimeter 1370 of the first forefoot section 1346 is equal to or slightly smaller than the perimeter 1374 of the first forefoot aperture 1326, the first forefoot section 1346 compresses and/or the first forefoot aperture 1326 expands as the first forefoot section 1346 passes through the first forefoot aperture 1326. By the time the first forefoot aperture 1326 is aligned with the first groove 1356, the first forefoot section 1346 and/or the first forefoot aperture 1326 has returned to its/their uncompressed state(s), which locks the first forefoot section 1346 within the first forefoot aperture 1326. Specifically, because portions of the inner forefoot section 1314 of the vamp 1304 reside within the first groove 1356, those portions are partially covered by the portions of the inner forefoot section 1346 (e.g., the outer perimeter 1370) that passed through the first forefoot aperture 1326. In that process, the first band 1332 passes through the first channel 1352 and the second band 1334 passes through the second channel 1354. The elastic properties of the sole 1302 and/or vamp 1304 provide the securing forces, as the first forefoot aperture 1326 must expand and/or the first forefoot section 1346 (e.g., the outer perimeter 1370) must compress to remove the inner forefoot section 1314 from the first groove 1356. Thus, the elastic properties of the sole 1302 and/or the vamp 1304 secure the sole 1302 to the vamp 1304 without the need for an adhesive or cementing agent. In addition, by securing the sole 1302 to the vamp 1304 without adhesives, the sole 1302 may be removed and exchanged with a different sole.

In some embodiments, the first forefoot section 1346 may have a sloped surface 1394 so that the first forefoot section 1346 may pass more easily through the first forefoot aperture 1326. The first forefoot section 1346 may also have a flat surface 1396 designed to leverage the resistive properties of the materials and prevent removal. The second forefoot section 1348, the third forefoot section 1350, and the heel section 1344 are similarly locked into the second forefoot aperture 1328, the third forefoot aperture 1330, and the heel aperture 1356, respectively. The second forefoot section 1348, the third forefoot section 1350, and the heel section 1344 may likewise have a sloped surface and a flat surface.

Figure 46:
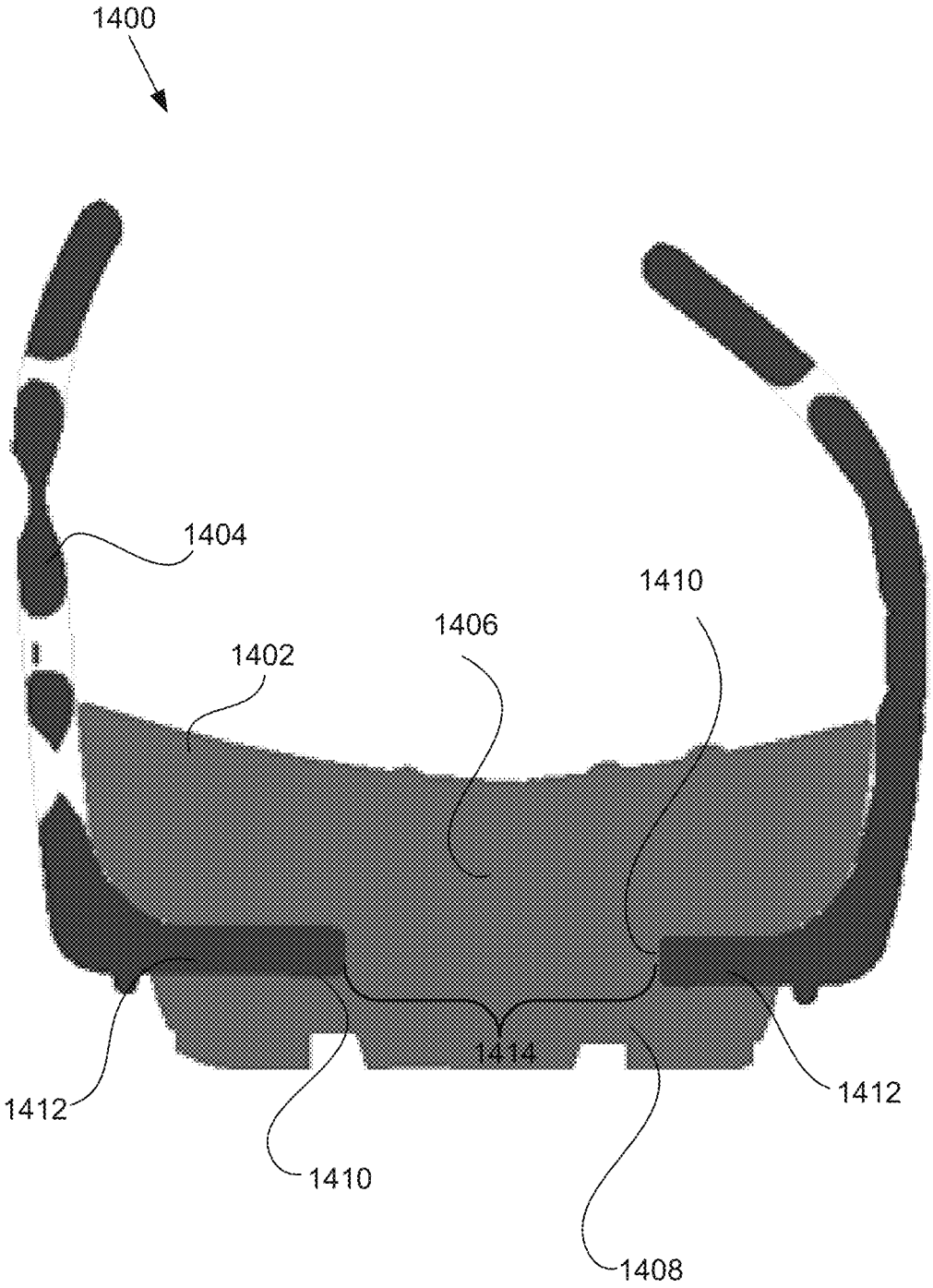
FIG. 46 illustrates a rear cross-sectional view of a shoe assembly according to embodiments of the present invention.

FIG. 46 illustrates a cutaway view of a shoe assembly 1400. The shoe assembly 1400 includes a sole 1402 and a vamp 1404. The sole has an upper portion 1406 and a lower portion 1408 that are at least partially divided by a groove 1410. In some embodiments, the groove 1410 forms a continuous loop around the entire sole 1402. In other embodiments, the groove 1410 forms a continuous loop around a portion of the sole 1402 or forms discrete groove sections within the sole 1402. The vamp includes an inner tongue 1412 that surrounds or defines an aperture 1414. In some embodiments, the inner tongue 1412 only partially surrounds or defines the aperture 1414.

To form the shoe assembly 1400, the lower portion 1408 of the sole 1402 is pressed through the aperture 1414. Because the lower portion 1408 of the sole 1402 is larger than the aperture 1414, it compresses as it passes through the aperture 1414. In other embodiments, the aperture 1414 expands to accommodate the lower portion 1408 of the sole 1402. In yet other embodiments, the lower portion 1408 compresses and the aperture 1414 expands to accommodate the combination of the two elements. Once the lower portion 1408 of the sole 1402 passes through the aperture 1414, it returns to its original shape. The inner tongue 1412 of the vamp 1404 rests inside the groove 1410. The sole 1402 is thus secured to the vamp 1404 without the need for cement or adhesive.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A shoe assembly comprising:

a vamp having a middle section and an upper section, the upper section configured to extend over a top of a foot when the foot is received by the shoe assembly, and the middle section configured to extend under the foot when the foot is received by the shoe assembly, wherein the vamp, including the middle section and the upper section, is formed of a single first molded material and defines a first aperture and a second aperture, the first aperture spanning the distance between a point immediately adjacent to an inner medial side and a point immediately adjacent to an outer lateral side of the vamp; and a sole comprising a forefoot section, a heel section, and a midfoot section, wherein the forefoot section and the heel section are joined by the midfoot section and wherein the forefoot section, the heel section, and the midfoot section are formed of a second molded material, wherein the second molded material is an EVA-based material;

wherein the first aperture receives the forefoot section and the second aperture receives the heel section;

wherein when the shoe assembly is placed on a flat surface, the forefoot section is in direct contact with the flat surface;

wherein the middle section and the upper section form a continuous element that encircles the sole; and wherein the middle section comprises one or more continuous bands extending from a first side of the vamp to an opposite side of the vamp.

2. The shoe assembly of claim 1, wherein the middle section of the vamp is adjacent to the forefoot section that is received in the first aperture, and wherein the midfoot section is adjacent to the heel section that is received in the second aperture.

3. The shoe assembly of claim 1, wherein the heel section is configured to be in direct contact with the flat surface when the shoe assembly is placed on the flat surface.

4. The shoe assembly of claim 3, wherein the vamp includes a lower portion and the middle section forms part of the lower portion, and wherein the vamp does not contact the flat surface when the shoe assembly is placed on the flat surface.

5. The shoe assembly of claim 1, wherein the first molded material is thermoplastic polyurethane.

6. The shoe assembly of claim 1, wherein the vamp includes a foot opening and the heel section includes an upper rim, wherein a first portion of the upper rim of the heel section extends into the foot opening.

7. The shoe assembly of claim 6, wherein a second portion of the upper rim resides below the foot opening.

8. The shoe of claim 1, wherein the vamp comprises a clog vamp.

9. The shoe of claim 1, wherein the vamp comprises a sandal vamp.

10. The shoe of claim 1, wherein the vamp comprises a slipper vamp.

11. The shoe assembly of claim 1, wherein the forefoot section has a forefoot ridge, and the first aperture has a lower surface that contacts the forefoot ridge.

12. The shoe assembly of claim 1, wherein the first molded material is translucent and the second molded material is opaque.

13. The shoe assembly of claim 12, wherein the first material has a first color, the second material has a second color, and wherein the second color is darker than the first color.

14. The shoe assembly of claim 12, wherein the second molded material is visually perceptible through the first molded material in the shoe assembly.

15. The shoe assembly of claim 1, wherein the heel section includes a heel ridge and the vamp includes an outer heel perimeter, and wherein the heel ridge is wider than the outer heel perimeter.

16. The shoe assembly of claim 15, wherein the heel ridge is configured to pass through the outer heel perimeter when the second aperture receives the heel section, and wherein the heel ridge is configured to compress when passing through the outer heel perimeter.

17. The shoe assembly of claim 16, wherein the outer heel perimeter is configured to expand when the heel ridge passes through the outer heel perimeter, and wherein the outer heel perimeter is configured to exert a biasing force against the sole.

18. The shoe assembly of claim 1, wherein the heel section includes a heel ridge and the vamp includes an outer heel ridge, and wherein the heel ridge has substantially equal dimensions to the outer heel ridge.

19. The shoe assembly of claim 1, wherein the sole further comprises at least one channel, and wherein the at least one channel receives a portion of one of the one or more continuous bands of the vamp.

20. The shoe assembly of claim 1, wherein the one or more continuous bands have a consistent band width extending from the first side to the opposite side.

21. The shoe assembly of claim 1, wherein, at least one of the one or more continuous bands is bordered only by the first aperture and the second aperture.

22. A shoe comprising:

a vamp having an upper section and one or more extensions, wherein the one or more extensions form one or more continuous bands from a first side of the vamp to an opposite side of the vamp, the upper section configured to extend over a top of a foot when the foot is received by the shoe, the vamp, including the one or more extensions and the upper section, being formed of a single first molded material and defines a first aperture and a second aperture, the first aperture spanning the distance between a point immediately adjacent to an inner medial side and a point immediately adjacent to an outer lateral side of the vamp; and a sole comprising an EVA-based material, wherein the one or more extensions and the upper section form a continuous element that encircles the sole;

wherein the sole is formed of a second molded material, wherein the sole is adapted to touch the foot and to touch the ground when the foot is received by the shoe assembly, and wherein the sole includes at least one channel, and wherein the at least one channel receives a portion of one of the one or more extensions of the vamp, and wherein a first part of the sole adapted to touch the ground is formed at least in part by an outer perimeter of the sole.

23. The shoe of claim 22, wherein the sole includes a heel portion and the at least one channel includes a heel channel that receives a portion of the one or more extensions of the vamp.

24. The shoe of claim 22, wherein the sole includes a forefoot portion and the at least one channel includes a forefoot channel that receives the portion of one of the one or more extensions of the vamp.

25. The shoe of claim 24, wherein the sole further includes a heel portion and a midfoot portion, and when the shoe is placed on a flat surface, a part of the heel portion, a part of the forefoot portion, and a part of the midfoot portion are each in direct contact with the ground surface.

* * * * *